US005224604A

United States Patent [19]

Duczmal et al.

[11] Patent Number: 5,224,604

[45] Date of Patent: Jul. 6, 1993

[54] APPARATUS AND METHOD FOR SEPARATION OF WET AND DRY PARTICLES

[75] Inventors: Tomasz Duczmal; Jakob H. Schneider, both of Calgary, Canada

[73] Assignee: Hydro Processing & Mining Ltd., Calgary, Canada

[21] Appl. No.: 594,350

[22] Filed: Oct. 9, 1990

Related U.S. Application Data

[63] Continuation-in-part of Ser. No. 508,116, Apr. 11, 1990, abandoned.

[51] Int. Cl.[5] ..... B03C 1/30; B03D 1/24; B04C 3/06

[52] U.S. Cl. ..... 209/12; 209/39; 209/127.1; 209/128; 209/223.2; 209/228; 209/211; 209/144; 210/512.1; 210/221.2; 210/223

[58] Field of Search ..... 209/12, 39, 211, 144, 209/170, 127.1, 214, 224, 232, 228, 128, 212, 213, 223.2; 210/223, 221.2, 512.1, 905; 55/100, 101, 127, 459.1; 435/173

[56] References Cited

U.S. PATENT DOCUMENTS

| | | | |
|---|---|---|---|
| 1,056,318 | 3/1913 | Bruck | 209/211 |
| 2,769,546 | 11/1956 | Fontein | 210/512.1 |
| 2,781,910 | 2/1957 | Fontein | 210/512.1 |
| 2,963,154 | 12/1960 | Vane | 209/211 |
| 2,967,618 | 1/1961 | Vane | 209/211 |
| 3,012,671 | 12/1961 | Ziemer . | |
| 3,286,844 | 11/1966 | Juell . | |
| 3,351,195 | 11/1967 | Hukki | 209/39 |
| 3,391,787 | 7/1968 | Salomon | 210/512.1 |
| 3,452,870 | 7/1969 | Katsuta et al. . | |
| 3,557,956 | 1/1971 | Braun | 209/211 |
| 3,875,061 | 4/1975 | Palma | 210/223 |
| 4,017,385 | 4/1977 | Morton | 209/39 |
| 4,094,783 | 5/1978 | Jackson . | |
| 4,214,982 | 7/1980 | Pfalzer . | |
| 4,265,741 | 5/1981 | Im | 209/211 |
| 4,279,743 | 7/1981 | Miller | 209/211 |
| 4,289,611 | 9/1981 | Brockmann . | |
| 4,331,534 | 5/1982 | Barnscheidt . | |
| 4,343,707 | 8/1982 | Lucas . | |
| 4,378,289 | 3/1983 | Hunter | 210/512.1 |
| 4,397,741 | 8/1983 | Miller | 209/170 |
| 4,399,027 | 8/1983 | Miller | 209/164 |
| 4,414,112 | 11/1983 | Simpson | 210/512.1 |
| 4,416,771 | 11/1983 | Henriques | 209/39 |
| 4,478,711 | 10/1984 | Cohen | 209/223.2 |
| 4,490,248 | 12/1984 | Filippov et al. . | |
| 4,512,888 | 4/1985 | Flynn . | |
| 4,560,474 | 12/1985 | Holik . | |

(List continued on next page.)

FOREIGN PATENT DOCUMENTS

| | | | |
|---|---|---|---|
| 853025 | 10/1970 | Canada . | |
| 1117875 | 2/1982 | Canada . | |
| 1175621 | 8/1964 | Fed. Rep. of Germany . | |
| 2812105 | 9/1979 | Fed. Rep. of Germany . | |
| 3524071 | 1/1987 | Fed. Rep. of Germany . | |
| 1131800 | 2/1957 | France | 209/211 |
| 90/02608 | 3/1990 | PCT Int'l Appl. . | |
| 46595 | 3/1963 | Poland | 209/224 |

(List continued on next page.)

*Primary Examiner*—Thomas M. Lithgow
*Attorney, Agent, or Firm*—Basile and Hanlon

[57] ABSTRACT

Apparatus and method for the separation of particles in either a liquid or gas stream is provided. The fluid stream is directed in a swirl-flow pattern to develop thereby centrifugal forces on the stream. Optionally, magnetic and/or electrical fields may be applied to the system to enhance separation of the particles. Air sparging may also be employed to further enhance the separation of hydrophilic particles from hydrophobic particles in a liquid system. Optionally, the swirl-flow pattern may exit the downstream end of the separator where a stream splitter is employed to split the swirl-flow pattern stream which splays outwardly at the outlet in two or more streams which carry desired particles to be recovered.

7 Claims, 10 Drawing Sheets

U.S. PATENT DOCUMENTS

| | | | |
|---|---|---|---|
| 4,594,149 | 6/1986 | Andres | 209/214 |
| 4,608,155 | 8/1986 | Desportes | 209/224 |
| 4,702,837 | 10/1987 | Lecoffre | 210/512.3 |
| 4,722,784 | 2/1988 | Barnscheidt . | |
| 4,726,686 | 2/1988 | Wolf | 210/512.1 |
| 4,744,890 | 5/1988 | Miller | 209/164 |
| 4,819,808 | 4/1989 | Andres | 209/214 |
| 4,838,434 | 6/1989 | Miller | 210/512.1 |
| 4,855,045 | 8/1989 | Reed | 210/223 |
| 4,876,016 | 10/1989 | Young | 210/512.1 |
| 4,941,969 | 7/1990 | Schonert | 209/39 |
| 4,952,308 | 8/1990 | Chamberlin et al. . | |
| 4,971,685 | 11/1990 | Stanley | 210/512.1 |
| 4,997,549 | 3/1991 | Atwood | 210/512.1 |
| 5,008,014 | 4/1991 | Lloyd | 210/512.1 |
| 5,028,318 | 7/1991 | Aslin | 210/512.1 |
| 5,069,751 | 12/1991 | Chamblee | 210/703 |
| 5,084,189 | 1/1992 | Richter | 209/211 |

FOREIGN PATENT DOCUMENTS

| | | | |
|---|---|---|---|
| 115971 | 3/1946 | Sweden | 209/170 |
| 385622 | 8/1968 | U.S.S.R. | 209/39 |
| 440160 | 9/1972 | U.S.S.R. | 209/170 |
| 545385 | 6/1975 | U.S.S.R. | 209/170 |
| 514632 | 8/1976 | U.S.S.R. | 209/39 |
| 655432 | 4/1979 | U.S.S.R. | 209/39 |
| 692634 | 10/1979 | U.S.S.R. . | |
| 1005921 | 3/1983 | U.S.S.R. | 209/169 |
| 1036385 | 8/1983 | U.S.S.R. | 209/39 |
| 1278035 | 12/1986 | U.S.S.R. | 209/170 |
| 1421407 | 9/1988 | U.S.S.R. | 209/211 |
| 1488005 | 6/1989 | U.S.S.R. | 209/39 |
| 1535633 | 1/1990 | U.S.S.R. | 209/39 |
| 1607960 | 11/1990 | U.S.S.R. | 209/170 |
| 1059828 | 11/1963 | United Kingdom . | |
| 1322229 | 7/1970 | United Kingdom . | |
| 1567204 | 11/1976 | United Kingdom . | |
| 2162092 | 1/1986 | United Kingdom . | |

FIG. 3A
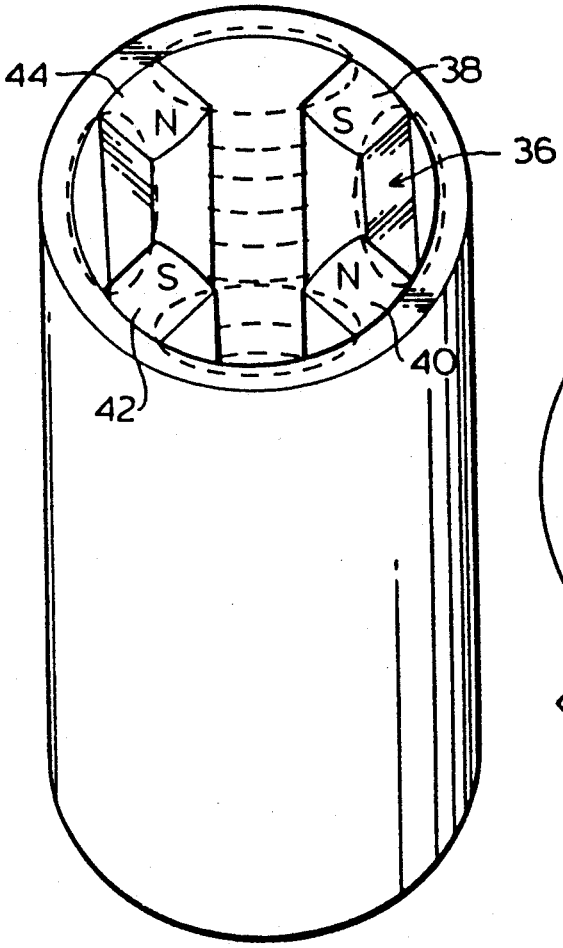
FIG. 3B
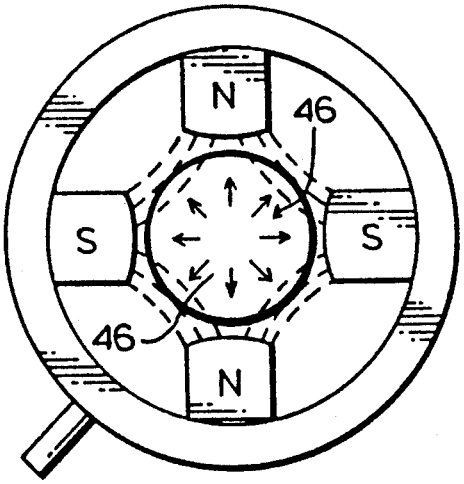
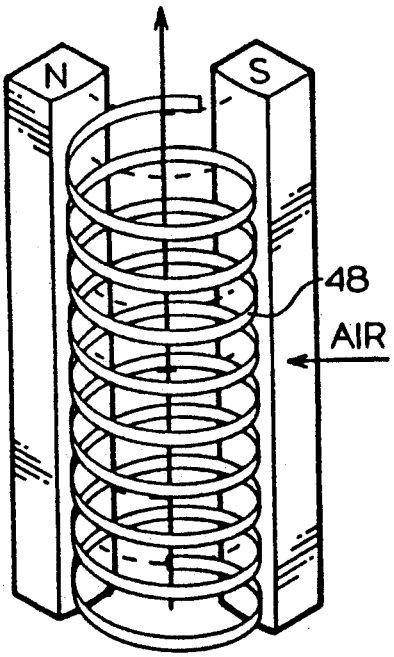
FIG. 4A
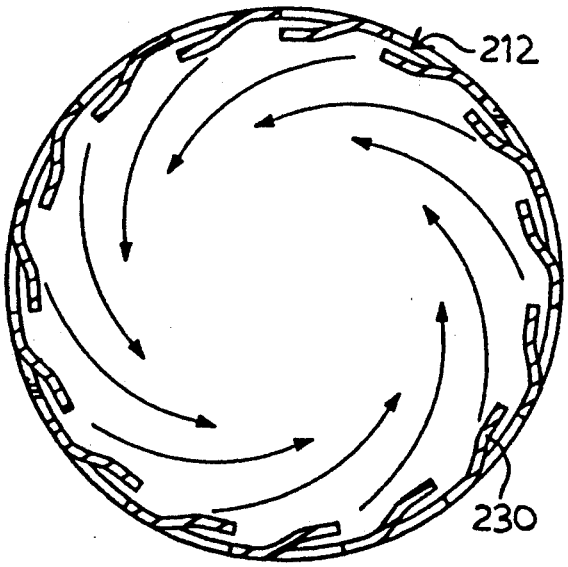
FIG. 11

APPARATUS AND METHOD FOR SEPARATION OF WET AND DRY PARTICLES

This application is a continuation-in-part of application Ser. No. 508,116 filed Apr. 11, 1991 (now abandoned).

FIELD OF THE INVENTION

The present invention relates to improved apparatus and method for separation of particles in a particulate suspension. More particularly, the invention relates to apparatus and methods wherein separation is achieved in an apparatus combining a centrifugal field with a radial magnetic field and/or electrical field.

BACKGROUND OF THE INVENTION

A. Air-Sparged Hydrocyclones

Flotation systems are important unit operations in process engineering technology that were developed to separate particulate constituents from slurries. Flotation is a process whereby air is bubbled through a suspension of finely dispersed particles, and the hydrophobic particles are separated from the remaining slurry by attachment to the air bubbles. The air bubble/particle aggregate, formed by adhesion of the bubble to the hydrophobic particles, is generally less dense than the slurry, thus causing the aggregate to rise to the surface of the flotation vessel. Separation of the hydrophobic particles is therefore accomplished by separating the upper layer of the slurry which is in the form of a froth or foam, from the remaining liquid.

The fundamental step in froth flotation involves air bubble/particle contact for a sufficient time to allow the particle to rupture the air-liquid film and thus establish attachment. The total time required for this process is the sum of contact time and induction time, where contact time is dependent on bubble/particle motion and on the hydrodynamics of the system, whereas induction time is controlled by the surface chemistry properties of the bubble and particle.

However, flotation separation has certain limitations that render it inefficient in many applications. Particularly, flotation is not very effective for the recovery of fine particles (less than 10 microns in diameter). This can be a serious limitation, especially in the separation of fine minerals. An explanation for this low recovery is that the particle's inertia is so small that particle penetration of the air bubble film is inhibited, thus resulting in low rates of attachment to the bubbles.

A further limitation of conventional flotation systems is that nominal retention times in the order of several minutes are required to achieve successful separation. However, it has been shown that air bubble/particle attachment is frequently in the order of milliseconds, therefore indicating that the rate of separation is mostly limited by bubble-to-particle collisions and/or transport rather than by other factors. As such, these long retention times severely limit plant capacity and require the construction of relatively large and expensive equipment.

Air-sparged hydrocyclones (hereinafter "ASH") were developed to overcome these two limitations of conventional flotation systems. U.S. Pat. Nos. 4,279,743, 4,397,741, 4,399,027 and 4,744,890 disclose the conventional ASH and certain improvements thereon. ASHs combine flotation separation principles with centrifugal forces to achieve successful separation of finer particles with retention times in the order of several seconds. A controlled high force field is established in the ASH by causing the slurry to flow in a swirling fashion, thereby increasing the inertia of the finer particles. Also, high density, small diameter air bubbles are forced through the slurry to increase collision rates with the particles. The net result is flotation rates with retention times approaching intrinsic bubble attachment times. This corresponds to a capacity that is at least 100 to 300 times the capacity of a conventional mechanical or column flotation unit.

In ASH flotation, fluid pressure energy is used to create rotational fluid motion (swirling motion). This is done by feeding the slurry tangentially through a conventional cyclone header into a cylindrical vessel. A swirl flow of a certain thickness is developed in the circumferential direction along the vessel wall, and is discharged through an annular opening created between the vessel wall and a pedestal located axially on the vessel's bottom.

Air is introduced into the ASH through the jacketed porous vessel walls, and is sheared into numerous small bubbles by the high velocity swirl flow of the slurry. Hydrophobic particles in the slurry collide with the air bubbles, attach to the bubbles, and are transported radially by the bubbles into a froth phase that forms in the cylindrical axis. The froth phase is supported and constrained by the pedestal at the bottom of the vessel, thus forcing the froth to move upward towards the vortex finder of the cyclone header, and to be discharged as an overflow product. The hydrophilic particles, on the other hand, generally remain in the slurry phase, and thus continue to move in a swirling direction along the porous vessel wall until they are discharged with the slurry phase through the annulus opening between the vessel wall and the pedestal.

It is important to note that the swirling motion of the slurry along the vessel wall forms a "swirl-layer" that is distinguishable from the forth phase at the center of the cylindrical vessel. One important characteristic of the swirl-layer is that it has a net axial velocity toward the underflow discharge annulus between the vessel wall and the froth pedestal. The thickness of the swirl-layer is generally 8% to 12% of the vessel radius, and it increases with increasing air flow rate and with axial distance from the cyclone header, being greatest at the underflow discharge annulus.

The size and motion features of the froth formed along the cylindrical vessel's axis are dependent on operating conditions and feed characteristics. Between the swirl-layer and the froth core, there exists a transition region for the slurry, where the net velocity in the axial direction is either zero, or in the same direction as the slurry phase. The latter condition exists where the forth core is relatively small, thus leaving a large gap between the swirl-layer and the froth core track is filled with slurry. The most desirable condition is when the transition region is minimal, that is when the froth core is large enough to leave little space between it and the swirl-layer.

A pressure drop is created in the froth core, between the froth pedestal and the vortex finder outlet located axially at the top of the vessel. This pressure drop is the force that actually drives the froth axially upwards. There are three factors that affect the pressure drop in the forth core:

1. restriction of the slurry flow to the underflow discharge annulus;
2. restriction of the froth transport to the overflow vortex finder opening; and
3. continuous supply of fresh froth to the froth core from the swirl-layer.

Factors 1 and 2 are in turn dependent on the particular application and can be adjusted during the operation. Factor 3 is dependent on air flow rate and on the hydrophobic properties of the particles, and their weight fraction in the feed slurry.

An immediate advantage of the ASH is the directed motion and intimate contact between the particles in the swirl-layer on the porous vessel wall and the freshly formed air bubbles. The high centrifugal force field developed by the swirling slurry imparts more inertia to the fine particles so that they can impact the bubble surface and attach to the bubbles. As a result, separation of fine particles is enhanced.

However, ASHs are relatively poor separators of coarser hydrophobic particles because the velocity of the swirling slurry imparts too high an inertia to these particles, thus preventing these particles from attaching to the air bubbles. As such, to achieve separation of these coarser particles, it is necessary that they exhibit relatively strong hydrophobicity so that the bubble/-particle aggregate are stable under the prevailing hydrocyclone conditions. In cases where hydrophobicity is not strong enough, the system will exhibit some characteristics of a classification cyclone in that the coarse hydrophobic particles will be transported by the slurry to the underflow discharge annulus, while the finer particles will have a tendency to be transported into the froth core and out through the overflow vortex finder.

Studies have shown that the separation efficiency for a number of mineral particles falls as particle diameters increase above 100 microns. However, other studies show that the upper particle size limit is strongly affected by the hydrophobicity of the particle (as discussed above), and thus can be extended beyond 100 microns. For coal particles, testing shows that separations of particles above 100 to 400 microns drops significantly with increasing slurry pressure.

Therefore, an important addition to the art would occur if a method and apparatus is developed that can effectively separate particles of sizes beyond the present range of particle sizes. Also, a significant improvement would occur if increased slurry pressure (therefore increased feed flow rates) can be used while maintaining efficient separation.

B. Open Gradient Magnetic Separation

Open gradient magnetic separation (OGMS) is a generic term used to describe any process involving magnetic separation achieved by particle deflection in non-uniform magnetic fields. OGMS is based on the magnetic force acting on a small particle in an inhomogeneous field and can be described as:

$$\vec{F}_m = V_p J_p \nabla \vec{B}_o / \mu_o \quad (1)$$

where:

$\vec{F}_m$ is the magnetic force $V_p$ is the volume $J_p$ is the magnetic polarization of the particle $\nabla \vec{B}_o$ is the gradient of the external magnetic field $\mu_o$ is the permeability of the medium.

$J_p$ can be expressed as:

$$J_p = \frac{\chi}{1 + \chi D} B_o \quad (2)$$

where $\chi$ is the magnetic susceptibility of the particle;

D is the demagnetizing factor of the particle, and is $O < D < 1$; and

B is the magnetic flux density.

For paramagnetic particles, $D << 1$, therefore $J_p \chi B_o$, and equation (1) becomes:

$$\vec{F}_m = V_p \chi B_o \nabla \vec{B}_o / \mu_o \quad (3)$$

For ferri- and ferromagnetic particles, x will be dependent on the magnetic field, and $J_p$ usually reaches a saturation value, $J_{ps}$, in a relatively low field. Therefore, from equations (1), (2) and (3), we can see that efficient separation will occur if the magnetic flux density $B_o$, and its gradient $\nabla \vec{B}_o$ are sufficiently high.

Hundreds of different kinds of magnetic separators have been constructed in the last two centuries. In these separators, the necessary magnetic conditions are obtained either by using the field and the gradient of a permanent or an electromagnet, or by placing in the homogeneous field secondary ferromagnetic particles that give rise to field gradients around them. In the latter case, the gradients are often several orders of magnitude higher than in the former, but the resulting force is of shorter range because the maximum field is limited.

Open-gradient magnetic separators belong to the first group. The field and its gradient are produced by a suitable arrangement of magnets. The range of the force is of the order of a few centimeters. The operating principle of the separators is that a beam of particles flow through the magnetised area is split into two or more parts. The force that deflects the particles is often modest, but due to the relatively long residence time in the field provides a continuous separation without particles being accumulated in the magnetized space.

The degree of success of OGMS depends upon the deflection imparted to the particles. This, in turn, depends upon four factors:

(i) the particles themselves (size, magnetic susceptibility, density);

(ii) the retention time of separating forces acting on particles;

(iii) the magnitude and geometry of the non-uniform magnetic field; and (iv) the geometry of magnetic and non-magnetic discharge posts.

One possible configuration provides for dry separation of ore particles, wherein the particles are made to fall through a magnetic field. As the particles fall, they are deviated by their relative attraction to, or repulsion from, the poles, and the resultant stream of ore is divided in two or more components by separating boxes.

In wet-magnetic separators, one design requires the positioning of a long rectangular channel adjacent to a magnet. The slurry is then fed through the channel, and separation occurs as the particles are influenced by the magnetic field.

Other types of OGMS are continuous units employing specially designed magnets to generate strong field gradients in a relatively large, open working volume, in which flowing slurry is effectively split into magnetic and non-magnetic streams.

A further type of OGMS is a helical flow superconducting magnetic ore separator consisting of a superconducting dipole with a cylindrical annular slurry channel around one section [M. K. Abdelsalam, IEEE Transactions on Magnetics, Vol. Mag. 23, No. 5, September, 1987]. Helically flowing particles are forced outward due to the centrifugal force, and this is in turn opposed by magnetic forces on the magnetic particles. When a slurry flows helically in the annulus, non-magnetic particles experience a radially outward centrifugal force. Magnetic particles, on the other hand, experience an inward magnetic force in addition to the outward centrifugal force. Separation is thereby achieved if the magnetic force is strong enough to deflect the magnetic particles inward.

In the latter arrangement, magnetic forces act in opposite directions to the centrifugal forces, thereby substantially reducing the separation power of the apparatus. When the magnetic force equals the centrifugal force, no separation occurs since the magnetic particles do not experience any deflecting force. Therefore, the magnetic force needed must be substantially greater than the centrifugal forces generated in the apparatus.

C. Radial Gravity Separation

Gravity concentration may be defined as that process where particles of mixed sizes, shapes, and specific gravities are separated from each other by the force of gravity or by centrifugal force. The nature of the process is such that size and shape classification are an inherent part of the process in addition to separation on the basis of specific gravity from whence the process got the name. For coarse size minerals, efficient specific gravity separation has been possible for many years with open-bath vessels using the natural settling velocity or buoyancy of the particles. If vessel size remains within an economical limit, the particles in the bath vessels must have high setting rate in a 1G gravitational field. To extend a sufficient specific gravity separation of smaller sizes, the gravitational acceleration of particles is replaced by artificial radial gravity field sometimes called centrifugal field. The settling of small particles in a fluid in a centrifugal force field is similar to that found in a static bath except that the acceleration due to gravity "g" is replaced by a radial gravity acceleration.

To date, the most effective use of this principle has been obtained with devices that rotate a liquid or suspension within a stationary enclosure in order to create radial gravity force. When a slurry is injected into a cylinder in an involuted manner, laminar circular flow will be achieved and heavier particles will be moved outward. This process will be more effective if the flowing medium flows in a laminar manner. This means that all particles in the slurry layer have the same angular velocity and there is no relative movement of the particles in respect to each other. The only exception is slow outward drift of heavier particles. After leaving the cylinder, the flow stream possesses particle distribution by mass. Heavier particles are closer to the cylinder wall; while lighter particles are equally dispersed over a stream volume.

D. Froth Flotation

As previously explained, separation of hydrophobic particles is accomplished by separating the upper layer of the slurry which is in the form of a froth or foam from the remaining liquid. Bath flotation has brought applicability of the process with respect to particle size and its effective from 8 to 10 mesh below. More so than for any other separation process, flotation has almost no limitations in separating minerals.

Flotation machines provide the hydrodynamic and mechanical conditions which effect the actual separation. Apart from the obvious requirements of feed entry and tailings exit from cells and banks and for hydrophobic or mechanical froth removal, the cell must also provide for:

1. effecting suspension and dispersion of small particles to prevent sedimentation and to permit contacting with air bubbles;
2. influx of air, bubble formation, and bubble dispersion;
3. conditions favoring particle bubble contact and attachment;
4. a non-turbulent surface region for stable froth formation and removal; and
5. in some cases sufficient mixing for further mineral reagent interaction.

The following lists some of the more important mechanisms occurring in flotation machines.

PULP: Bubble genecies; particle/bubble relative flow path; thinning and rapture of separating liquid films; highly aerated impeller region and less aerated reminder with intense recycle flow between two regions; steep pulp velocity gradients especially in the presence of frothing agent; distribution of residence time of solids.

FROTH: Concentration gradients arising from selective and clinging action of froth column; bubble coalescence; concentration gradients may be represented by layering with step-wise concentration changes and two way mass transfer between the layers.

PULP-FROTH TRANSITION: Two-way solid and liquid mass transfer between phases.

AIR: Proves the motive force for both solids and water transfer from pulp to froth.

WATER: Transported by air and all solids non-selectively at increasing rate with decreasing particle size, into froth column, aids return of solids from froth and pulp by drainage.

The rate of flotation of particle by bubble can be expressed as the product of the probability of collision $P_c$ between the particle and bubble, the probability of attachment $P_a$ between the bubble and particle, the probability of bubble with particle attachment entering froth $P_f$, and the probability of bubble and particle remaining attached throughout the flotation process $P_s$.

$$k = P_c \cdot P_a \cdot P_a \cdot P_s$$

For the most part, the probability of attachment depends upon the surface characteristics of the mineral and the degree of collector adsorption on the mineral surface. It was shown that induction time for attachment decreases as the particle size decreases. Because of the shorter induction time, fine particles should float faster which does not explain the observed decline in flotation efficiency for fine size particles.

The probability of a particle remaining attached to a bubble depends upon the degree of turbulence found in the system. The same forces that drove the particle and bubble together are available to separate them. It was shown that:

$$P_s = 1 - \left(\frac{d_p}{d_{pmax}}\right)^{3/2}$$

Where $d_p$ is the particle diameter and $d_{pmax}$ is the maximum particle that will remain attached under the prevailing turbulent conditions. The probability is slowest for coarse size particles and approaches unity for fine size particles. Once attached the probability of remaining particles being attached is very high for fine size particles. Based on these considerations, it appears that for fine particles the poor probability of collision is the main reason for the poor flotation. This means that the hydrodynamic forces are very important for flotation of fine particles.

The probability of collision depends upon the number and size of the particles and the bubbles and the hydrodynamics of the flotation pulp. This probability is directly related to the number of collisions per unit time and per unit volume. It can be presented by the formula for the number of collision in flotation systems as:

$$N_c = 5 \cdot N_p \cdot N_b \cdot r_{bp} \cdot (V_b^2 + V_p^2)^{\frac{1}{2}}$$

Where $N_p$ is the number of particles, $N_b$ is the number of bubbles, $r_{bp}$ is the sum of the particles and the bubble radii, and $V_b^2$ and $V_p^2$ are a means square of the effective relative velocity between the particles and bubbles. From the equation, it can be seen that by increasing the number of bubbles and the relative velocity of the bubbles and particles, the number of collisions can be increased for given pulp.

The final factor affecting k is bubble loading. Bubble loading is not yet well understood, but it essentially limits the capacity of the bubbles to carry particles out of the flotation cell. As the feed rate increases for a given aeration rate, the bubbles become more fully loaded. When the bubbles become more than 50% loaded, $P_s$ decreases as the particle residence time on the bubble is shortened and as the available bubble surface for attachment is reduced. The net effect is a decrease in the volume of k. In addition, bubble loading may also influence the coalescence of bubbles with the flotation cells, which would have a much more pronounced effect on k.

After the flotation rate constant, the retention time of particles in the flotation cell has the most significant impact on flotation recovery. Retention time is determine by dividing the effective volume of the flotation cell (corrected for air hold-up) by the flow rate of the liquids in the slurry entering or exiting the flotation cell. Thus all three parameters, flotation cell volume, liquid slush/slurry flow, and air hold-up, play a role in determining the retention time of the flotation cells. Conventional froth flotation is very effective for particles down to 20 micrometers in size, but the flotation efficiency drops off as the particle size decreases below 20 micrometers.

SUMMARY OF THE INVENTION

An apparatus for separating particles based on their different characteristics in a fluid stream which is moving in a swirl-flow manner comprises:

i) a vessel having a circular shaped interior wall;

ii) means for introducing said fluid stream into said vessel to develop said swirl-flow along said interior wall;

iii) at least a portion of said interior wall being porous, means for introducing air through said porous portion to form air bubbles in said fluid stream to enhance thereby separation of hydrophobic particles attracted to air bubbles which form particle/bubble aggregates from hydrophillic particles not attracted to air bubbles;

iv) magnetic means for developing a radial magnetic field and a magnetic field gradient within said vessel;

v) said magnetic means developing a magnetic field and magnetic field gradient at said vessel interior wall and a net zero magnetic field centrally of said vessel;

vi) said magnetic means enhancing particle separation of ferromagnetic and paramagnetic particles in such swirl-flow of fluid from diamagnetic particles;

vii) said air introducing means and said magnetic means provide in combination a radial distribution of particles in said fluid stream due to hydrostatic forces acting on said hydrophobic aggregates to move such radially inwardly of said fluid stream, centrifugal forces acting on said particles and aggregates to move such radially outwardly and magnetic field forces acting on said particles and said aggregates to move ferromagnetic and paramagnetic particles and aggregate radially outwardly and diamagnetic particles and aggregates radially inwardly.

According to another aspect of the invention, an apparatus for separating particles based on their different characteristics in a fluid stream comprises:

i) a circular shaped vessel having a circular shaped outlet;

ii) means for developing in said vessel a swirl-flow pattern of a fluid stream carrying such particles;

iii) means for developing a radial distribution of particles in such fluid stream by virtue of one or more physical, electrical or magnetic properties of such particles;

iv) said outlet being unobstructed at its periphery to permit such fluid stream travelling in a swirl-flow manner to splay outwardly in a conical manner beyond said periphery of said outlet;

v) a circular tube spaced from said outlet periphery;

vi) means for supporting said tube with a longitudinal axis for said tube being coincident with a central axis of said circular outlet, vii) said support means axially spacing an inlet periphery of said tube apart from said outlet periphery, said tube inlet diameter being such to intersect such outwardly splayed fluid stream to split such stream into two sub-streams whereby a majority of particles of a desired characteristic are in one of such sub-streams.

According to another aspect of the invention, an apparatus for separating particles in a gaseous fluid stream which is moving in a swirl-flow manner comprises:

i) a vessel having a circular shaped interior wall;

ii) means for introducing said fluid stream into said vessel to develop said swirl-flow along said interior wall;

iii) magnetic means for developing a radial magnetic field and a magnetic field gradient within said vessel;

iv) said magnetic means developing a strong magnetic field and magnetic field gradient at said vessel interior wall and a net zero magnetic field centrally of said vessel;

v) said magnetic means providing a radial distribution of particles in said fluid stream due move such radially outwardly and magnetic field forces acting on said particles to move ferromagnetic and paramagnetic particles radially outwardly and diamagnetic particles radially inwardly.

According to another aspect of the invention, a process for separating particles in a liquid stream comprises:

i) directing said liquid stream in a swirl-flow manner along a circular shaped interior wall of a vessel;

ii) introducing air through a porous portion of said interior wall to form air bubbles in said liquid stream to enhance thereby separation of hydrophobic particles attracted to air bubbles which form particle/bubbles aggregates from hydrophillic particles not attracted to air bubbles;

iii) developing a radial magnetic field and a magnetic field gradient at said vessel interior wall and a net zero magnetic field gradient centrally of said vessel to enhance particle separation of ferromagnetic and paramagnetic particles and aggregates in such swirl-flow of liquid from diamagnetic particles and aggregates;

iv) the combination of the introduction of air bubbles into said liquid stream developing hydrostatic forces on hydrophobic aggregates, the use of a magnetic field to exert magnetic field forces on said particles and aggregates and centrifugal forces exerted on said particles and aggregates provide a radial distribution across said stream of said particles and aggregates based on their physical and magnetic properties.

According to another aspect of the invention, a process for separating particles in a fluid stream comprises:

i) directing said fluid stream in a swirl-flow manner along a circular shaped interior wall of a vessel;

ii) developing a radial distribution of particles in said fluid stream by virtue of applying to said particles one or more of hydrostatic, magnetic and electrical forces in addition to centrifugal forces;

iii) providing a circular shaped outlet in said vessel which outlet is unobstructed at its periphery to permit thereby said fluid stream travelling in a swirl-flow manner to splay outwardly in a conical manner beyond said periphery of said outlet;

iv) dividing said outwardly splayed stream into two sub-streams where division of said stream is based on separating out with one of said sub-streams a majority of particles of a desired classification.

According to another aspect of the invention, a process for separating particles in a gaseous fluid stream comprises:

i) directing said gaseous stream in a swirl-flow manner along a circular shaped interior wall of a vessel;

ii) developing a radial magnetic field and a magnetic field gradient at said vessel interior wall and a net zero magnetic field centrally of said vessel to enhance particle separation by moving ferromagnetic and paramagnetic particles radially outwardly of said gas stream and by moving diamagnetic particles radially inwardly of said gas stream.

BRIEF DESCRIPTION OF THE DRAWINGS

Preferred embodiments of the invention are shown in the drawings wherein:

FIG. 3*a* is a perspective view of the cylindrical magnet in quadrapole configuration, with each pole being adjacent to a pole of opposite polarity;

FIG. 3*b* is a horizontal cross-section view of the preferred embodiment of the novel apparatus of the present invention, showing in particular the magnetic forces generated by the magnet;

FIGS. 4*a* and 4*b* are illustrations of the resultant force distributions acting on the particles in the slurry;

FIG. 11 is a section through the dry system of FIG. 10 showing the tangentially oriented apertures in the vessel wall.

DETAILED DESCRIPTION OF THE PREFERRED EMBODIMENTS

Figure 1:
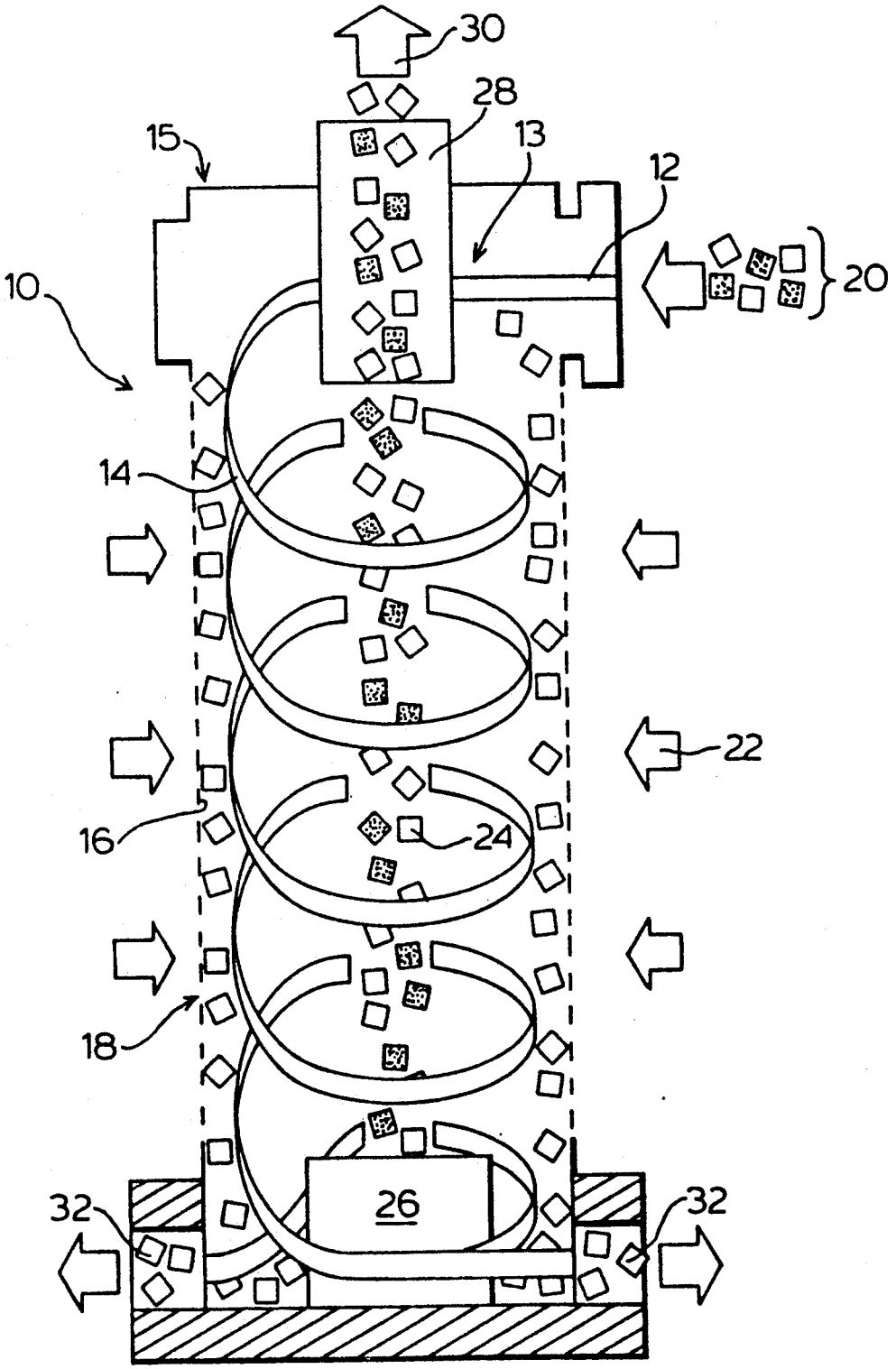
FIG. 1 is a longitudinal cross-sectional view of a conventional air-sparged hydrocyclone.

According to several aspects of the invention, details of which are provided in this description, a separation of particles in a fluid stream regardless of whether the stream is wet or dry is achieved by the application of external forces in addition to or other than the centrifugal and hydrostatic forces common to the standard type of air sparged hydrocyclone separator. By use of external forces, such as magnetic fields and electric fields, a more precise and greater degree of separation of particles of a desired characteristic from particles of another characteristic can be achieved. The radial separation of the particles is then accomplished by virtue of the various properties of the particles. For purposes of discussion, the properties are identical as physical, magnetic and electrical where it is understood that analyzed properties include characteristics such as density, hydrophobicity, porosity, size to volume ratios and the like.

The separation of the particles can be further enhanced by the use of a stream splitter which captures or removes a portion of the swirling stream as it flows downwardly through the apparatus to enhance separation of one group of particles of a certain characteristic from others in the moving stream. Such separation may be accompanied with air sparging where the particle/-bubble aggregates of hydrophobic particles may move downwardly, outwardly through the bottom of the vessel or in accordance with standard air sparged hydrocyclone techniques, forced to move upwardly of the vessel by use of a flotation pedestal at the vessel base and a vortex finder at the top of the vessel. The various principles of aspects of the invention shall be described firstly with reference to an embodiment of the invention in improving operation of the standard type of air sparged hydrocyclone.

The apparatus comprises a preferably vertically oriented cylindrical vessel having a tangential inlet at the upper end for introducing a slurry into the vessel. A swirl flow of a certain thickness is developed in the circumferential direction along the inside of the vessel wall, and is discharged through an annular opening created between the vessel wall and a pedestal located axially on the vessel's bottom.

Air is introduced into the cylindrical vessel through the jacketed porous vessel walls, and is sheared into numerous bubbles by the high velocity swirl flow of the slurry. Some of the particles in the slurry collide with the air bubbles, attach to bubbles, and are transported radially by the bubbles into a froth phase that forms in the cylindrical axis. Hydrophobic particles attach to the bubbles because repulsion of water molecules. However, hydrophillic particles as well can attach to air bubbles because of physical attraction whereby hydrophobic as well as hydrophillic bubbles can become floaters and flow upwardly. The froth phase is supported and constrained by the pedestal at the bottom of the vessel, thus forcing the froth to move upwards towards the vortex finder of the cyclone header, and to be discharged as an overflow product. The majority of the hydrophillic particles, on the other hand, generally remain in the slurry phase, and thus continue to move in a swirling direction along the porous vessel wall until they are discharged with the slurry phase through the annular opening between the vessel wall and the pedestal.

The outer wall of the hydrocyclone apparatus comprises a cylindrical magnet in quadrapole configuration. The poles are oriented towards the axis of the apparatus, and the quadrapole configuration provides radial magnetic field gradients with no component along the axis and with a net magnetic field at the centre of the vessel equal to zero. It is appreciated that the magnet can be energized by either permanent magnets or by electrical current. It is appreciated that the magnitude of the magnetic field and magnetic field gradient as well as radius of cylindrical magnet can be varied along the vertical axis in order to achieve a conical profile of separation force if required as dependent on its application.

The operation of the hydrocyclone includes introducing the slurry into the cylindrical vessel through a tangential inlet in the cyclone head at the top of the vessel. The slurry forms a thin layer against the inside surface of the porous wall. Air is continuously sparged through the porous wall and into the thin swirl-layer. Very small air bubbles are formed by the high shear velocity of the slurry against the porous wall. As the bubbles are formed at the porous wall, they collide with the particles and the slurry and form bubble/particle aggregates with the hydrophobic particles of the slurry. These bubble/particle aggregates move inwardly of the slurry layer to form a froth column in this type of hydrocyclone which is then removed axially through a vortex finder positioned at the top of the vessel.

The swirl-layer flowing circumferentially along the porous vessel wall, flows through the area of maximum magnetic field and maximum magnetic field gradients. Due to the circular motion of the slurry and to the radial geometry of the magnetic field gradient, the slurry flow is always perpendicular to the magnetic force.

Generally, there are two different forces acting on hydrophillic paramagnetic or ferromagnetic particles in the slurry. The first of these forces is the centrifugal force, $F_c$ that is due to the circular motion of the slurry. The second force is the magnetic attraction force, $F_m$. These two forces act on the particles in a direction radially outward from the centre of the cylindrical vessel.

On the hydrophobic and the diamagnetic particles which have formed aggregates with the air bubbles, there are generally three forces acting on them. They are the hydrostatic force, $F_h$, which is the force transporting the bubble/particle aggregate towards the froth core, the magnetic repelling force, $F_r$, and the centrifugal force, $F_c$. The hydrostatic and magnetic repelling forces act on the particles in a radially inward direction, whereas the centrifugal force acts on the particles in a radially outward direction. The combined action of these three forces is a net force acting radially inwardly towards the axial centre of the cylindrical vessel.

The operation of the flotation apparatus is discussed with respect to FIG. 1 and comprises the introduction of a slurry containing finely divided particles into the cylindrical vessel 10 through a tangential inlet 12 so as to create a swirling flow 14 around the inner surface 16 of the porous wall 18. The slurry is introduced under pressure so as to create a relatively strong centrifugal force. The slurry contains one or more particulate constituents 20 to be separated. The particulate constituents should either be naturally hydrophobic or rendered hydrophobic by the addition of a promoter or collector, or by other methods known in the art. Other particles which may be present in the particulate suspension, and which are not desired to be recovered, should be left hydrophillic.

After introduction into the vessel 10, the slurry forms a thin fluid layer against the inner surface of the porous wall. Air 22 or other gases are introduced into the cylindrical vessel 10 through the porous wall 18 and into the thin swirl layer of slurry formed against the inside surface 16 of the porous wall.

Upon passage through the porous vessel wall, the air is sheared into numerous small bubbles by the high velocity swirl flow of the slurry. The various particles in the slurry then collide with the air bubbles. If the inertia of the hydrophobic particles is high enough, these particles rupture the air-to-liquid film surrounding the bubbles and attach to the air bubbles. The bubble/-particle aggregates are transported into a froth core 24 that forms along the cylindrical axis of the vessel. The froth core 24 is supported and constrained by the pedestal 26 at the bottom of the vessel, and thus the froth is forced to move upwards towards the vortex finder 28 of the cyclone head and eventually discharged as an overflow product 30.

The hydrophillic particles 32, on the other hand, generally remain in the slurry phase, and thus continue to move in a swirling direction along the inside of a porous vessel wall until they are discharged with the slurry phase through the annular opening 34 between the vessel wall and the pedestal 26.

During the operation of the flotation apparatus, a mass gradient is created inside the cylindrical vessel wherein the region closest to the porous wall contains mostly water, whereas the region nearest the axis of the vessel contains mostly gas bubbles. The particles contained in the slurry feed are distributed within the swirl layer according to their density, size, shape, and hydrophobicity. Therefore, the hydrophobic particles will form air bubble/particle aggregates and be transported towards the cylindrical axis of the vessel, whereas the hydrophillic particles are forced towards the porous wall by the centrifugal force. The smaller hydrophillic particles, on the other hand are not necessarily forced against the inside of the porous wall, but will be distributed throughout the thin swirl-layer according to their mass, with the heavier particles closer to the porous wall.

Figure 2:
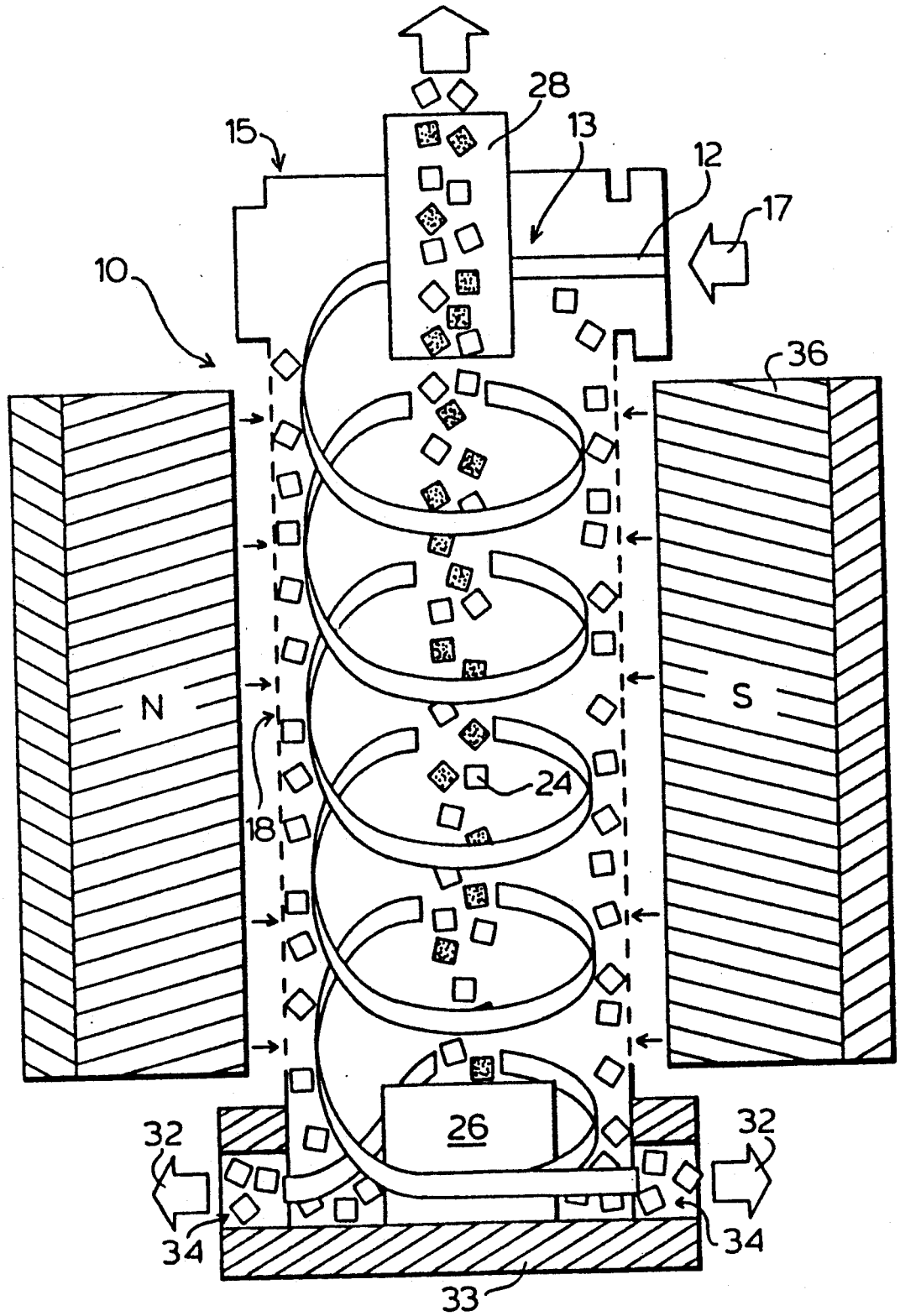
FIG. 2 is a longitudinal cross-sectional view of the preferred embodiment of the novel apparatus of the present invention showing in particular the addition of the magnet in quadrapole configuration surrounding the conventional air-sparged hydrocyclone.

A preferred embodiment of the present invention, as represented in FIG. 2, comprises a flotation apparatus, comprising a generally vertically oriented cylindrical vessel 10. A tangential inlet 12 is formed in a conventional cyclone header 13 at the upper end 15 of the cylindrical vessel 10 for receiving a slurry 17. An annular outlet 34 is formed at the lower end 33 of the vessel for directing fluid discharged from the slurry out of the vessel in an annular fashion. In this embodiment, the annular outlet 34 comprises an annular opening between the vessel wall and a pedestal 26 located axially on the vessel's bottom.

The vessel wall 10 is preferably formed as a porous wall, and an annular gas plenum 17 is located on the outside of the porous wall 18 with a gas inlet to provide gaseous communication between the gas source and the gas plenum. A generally cylindrical vortex finder 28 is mounted to the upper end of the vessel, the vortex finder being hollow to permit the passage of froth therethrough.

A froth pedestal 26 is positioned within the lower end 23 of the cylindrical vessel for supporting a froth core 24 which is formed during the operation of the apparatus. The pedestal is preferably centred within the vessel so as to minimize mixing between the froth and the slurry. The pedestal is secured to the vessel by any suitable means.

The improvement of the present invention over the prior art lies in replacing the outer wall of the cylindrical vessel by a cylindrical magnet 36 in quadrapole configuration. As shown in FIG. 3*a*, the poles 38, 40, 42 and 44 of the magnet 36 are oriented towards the axis of the cylindrical vessel, with each pole being adjacent to a pole of opposite polarity. It is appreciated that the magnet can be energized by permanent magnets or by electrical current. Quadrapole configuration of the magnets provides radial magnetic field gradients with no component along the axis and a net magnetic field at the axial centre of the cylindrical vessel equal to zero.

It is appreciated the shape of the magnetic field may be varied along the longitudinal axis of the cylindrical vessel. This variation can take the form of varying the magnitude of the magnetic field and magnetic field gradient as well as the radius of cylindrical magnet can be varied along the vertical axis to achieve, for example, a conical profile of separation force if required and as dependent on its application.

The inventive improvement of the present invention relates to the use of a cylindrical magnet in quadrapole configuration. As further illustrated in FIG. 3*b*, the quadrapole configuration of the magnet provides radial magnetic field gradients 46. Because the porous wall of the cylindrical vessel is inserted within the magnet, the layer of slurry swirling along the inside of the porous wall will flow through the area of maximum magnetic field and maximum magnetic field gradient. As shown in FIG. 4*a*, due to the circular motion of the swirl-layer inside the vessel, and because of the radial geometry of the magnetic field gradient, the slurry is always flowing perpendicularly to the magnetic force.

It will be appreciated that any solid particle placed in a magnetic field will be affected by it in some way. Solids may be classified into three categories depending on their magnetic properties:

1. diamagnetic particles, which are repelled by a magnetic field;
2. paramagnetic particles, which are attracted by a magnetic field; and
3. ferromagnetic particles, which are most strongly attracted by a magnetic field.

Although the process of this invention is particularly suited to the separation of discrete solid particles in coal and/or minerals, the process may also be used to separate biological particulate matter such as cells, labelled proteins and fragments thereof, solid and semi-solid waste materials and the like.

Figure 4B:
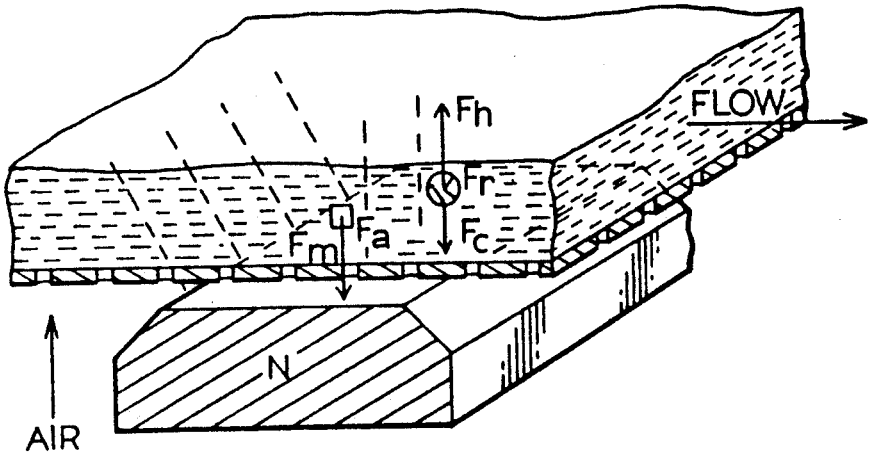

With reference to FIG. 4*b*, it will be noted that during operation of a flotation apparatus, there will be generally two forces acting on the hydrophillic paramagnetic or ferromagnetic particles. These two forces are the centrifugal force, $F_c$, and the magnetic attraction force, $F_m$. The centrifugal force is due to the swirling motion of the slurry along the inside porous wall of the vessel, whereas the magnetic attraction force is due to the magnetic force of the quadrapole magnet acting on the particles perpendicularly to the flow of the slurry. These two forces act in the same direction, that is, radially towards the outside of the cylindrical vessel. Therefore, the total force acting on the hydrophillic particles is the sum of the centrifugal force and the magnetic attraction force, and it acts radially outwards of the vessel. These resultant forces cause these particles to remain in the swirl-layer and to be eventually discharged through the annular opening between the vessel wall and the pedestal at the vessel's bottom. On the other hand, there are generally three forces acting on the hydrophobic and diamagnetic particles that have become attached to the air bubbles. These three forces are:

1. the hydrostatic force, $F_h$;
2. the magnetic repelling force, $F_r$, and
3. the centrifugal force, $F_c$.

The hydrostatic force is the force of the air bubble/particle aggregate that causes it to be transported radially inwardly towards the cylindrical axis. The magnetic repelling force, due to the quadrapole configuration of the magnet, acts on these particles in a direction radially inwardly towards the cylindrical axis. The third of these forces, the centrifugal force, is due to the swirling motion of the slurry, and acts on the particles in a radially outwardly direction from the cylindrical axis. For hydrophobic and diamagnetic particles that are not too large and have a specific gravity smaller than those of hydrophillic, the hydrostatic and magnetic repelling forces are greater than the centrifugal force, thereby causing a net force acting on these particles inwardly towards the cylindrical axis of the vessel. This resultant force causes these particles to be transported from the swirl-layer to the froth core.

From the above, it will be appreciated that the improvement of the present invention lies in the addition of the magnetic repelling force acting on the hydrophobic and diamagnetic particles, thereby allowing for efficient separation of smaller sized hydrophobic particles from the larger sized particles. Similarly, the addition of a magnetic attraction force acting on the hydrophillic paramagnetic or ferromagnetic particles allow for the efficient separation of finer hydrophillic particles which would otherwise have been entrained by the air bubbles out of the swirl layer and into the froth core.

The embodiment of the invention, as discussed with respect to FIGS. 1 through 3, demonstrate the manner in which centrifugal forces acting on the swirl-flow and optionally magnetic field forces serve to establish a radial separation of particles in the stream. Ideally, the swirl-flow is established in the vessel such that there is little, if any, relative movement of particles in the stream once separated by the effect of the centrifugal force field and magnetic force field, particularly as the swirl layer reaches the lower end of the vessel. According to another aspect of the invention, a novel approach in effecting separation of this flow is described with respect to the embodiment of FIG. 5. Unlike the system of FIGS. 1 through 3, which represents an improvement to the standard form of air sparged hydrocyclone, the embodiment of FIG. 5 removes the pedestal at the base of the vessel so that the swirl layer is permitted to leave the bottom of the vessel directly. Quite surprisingly, the open bottom for the vessel in an air-sparged hydrocyclone results in the bubble/particle aggregates travelling with the swirl-flow stream and outwardly through the bottom of the vessel. This result is unusual, but beneficial when other embodiments of the invention are considered because, based on standard air sparged hydrocyclone principles, it was generally understood that the bubble/particle aggregates would float upwardly of the vessel. Instead, what is achieved with the embodiment of FIG. 5 is not only a radial classification or gradation of particles across the thickness of the swirl-flow stream, but also an innermost radial layer of the bubble/particle aggregates. By use of the separating device of FIG. 5, the bubble/particle aggregate layer can be separated from the remainder of the particles which are radially located outwardly of the bubble/particle aggregates.

It is understood, however, that the separation device of FIG. 5 may also be used to cause a separation of particles in the swirl-flow stream regardless of whether or not air sparging is employed. As is generally understood, devices which work on the principle of circular flow of liquids or gases inside a cylindrical vessel establishes a radial gradient in the swirl-flow due to the centrifugal forces and, in accordance with other embodiments of this invention, due to magnetic field forces and electrical field forces. As the swirl-flow emerges from the open base of the vessel, the swirl layer may be split into two or more streams thereby causing a division of the particles in the stream where particles of one characteristic are on the outside of the splitting mechanism and particles of another characteristic are on the inside of the splitting mechanism.

Figure 5A:
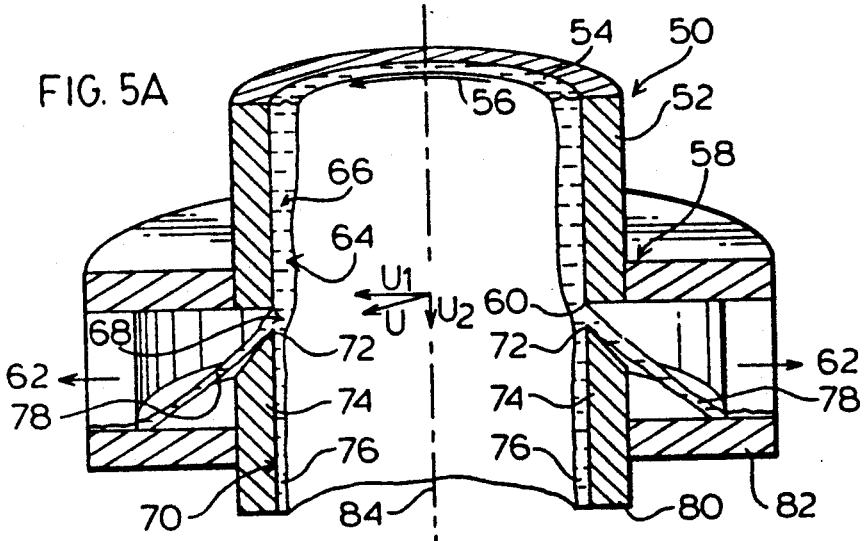
FIGS. 5*a*, 5*b* and 5*c* are sectioned views of the lower end of the separator having a stream splitter in place.

With reference to FIG. 5*a*, the cylindrical vessel 50 has a cylindrical wall 52 along which the swirl-flow layer 54 travels in the direction of arrow 56. The bottom region 58 of the vessel is open to present a circular outlet 60 at the bottom of the vessel 50. This allows the swirl-flow layer 54 to splay outwardly in the direction of arrows 62 about the periphery of the outlet 60. The swirl-flow layer 54, as it splays outwardly, maintains the radial gradient of particle separation established by one of more of the forces applied in the vessel 50. For example, in the section of the swirl-flow layer shown the radial inner portion 64 would be made up primarily of the bubble/particle aggregates when air sparging is used in the vessel wall 52. Radially outwardly of region 64 is a region 66 which would contain the hydrophillic particles as well as any ferromagnetic and paramagnetic particles should a magnetic force field be used as well. As shown in FIG. 5*a*, the outwardly splayed swirl-flow stream, generally designated 68, can be split into two streams. Such splitting of the outwardly splayed stream can be accomplished by any device which may be inserted into the stream to effect this splitting of the stream as it swirls in the direction of arrow 56.

According to the embodiment of FIG. 5*a*, the splitting is accomplished by insertion of a circular tube 70 into the outwardly splayed stream 68. The tube 70 has a knife edge 72 at its upper end 74. The knife edge 72 serves to precisely split the outwardly splayed stream into two downwardly directing flowing swirl streams 76 and 78. The knife edge 72 is positioned in the outwardly splayed stream 68 to effect a splitting at a radial location in the stream to separate particles of one desired characteristic in the stream 76 and particles of another desired characteristic in the stream 78. With the particular embodiment of FIG. 5*a*, where air sparging has been used to establish bubble/particle aggregates in region 64, and hydrophillic particles in region 66, the knife edge 72 is positioned to separate the bubble/particle aggregates layer from the layer 66 containing the hydrophillic particles. Hence, stream 76 consists primarily of the bubble/particle aggregates and stream 78 consists primarily of the hydrophillic particles. Stream 76, as it exists from the bottom 80 of the cylindrical tube 70, may be collected for further processing. Stream 78, as it exits in the direction of arrow 62 from outside of the tube 70, may be collected for further processing. Accordingly, with this embodiment of the invention for splitting the downwardly directed swirl-flow stream, the desired degree of separation of the radial gradient of particles in the stream can be achieved. As applied to systems which involve air sparging, the separation of the bubble/particle aggregates is conducted with greater efficiency compared to an air sparged hydrocyclone which requires flotation of the bubble/particle aggregates upwardly and out through the top of the vessel. Such splitting of the stream of the base of the vessel permits a splitting or division of the bubble/particle aggregates from the stream without requiring extraneous inward diffusion of the bubble/particle aggregates towards the centre of the vessel. Instead, they may be removed as they are formed from the radial innermost portion of the stream. Hence less vertical travel for the swirl-flow layer is required to achieve the desired separation of the bubble/particle aggregates from the remainder of the stream. Similarly, with other forms of radial separation of swirl-flow layers or circular flowing layers, the knife edge 72 of the circular tube is positioned to achieve this splitting of the stream.

The circular tube 70, as mounted on support 82, is concentric with the longitudinal axis 84 of the vessel. The support 82, with tube 70, may be moved along the axis 84 to vary the position of the knife edge 72. By moving the knife edge 72 towards or away from the outlet 60, the radial location in splitting of the outwardly splayed stream may be varied. Such adjustment can compensate for different types of particles being processed which can be of different radial distances in the swirl-flow layer. For example, with various types of minerals as separated by the apparatus of this invention, the radial location of the desired particles may be located in a thin layer proximate the inner wall of the cylinder 52. This requires moving the knife edge 72 very close to the bottom outlet 60 to provide for dividing of the stream of the thin outer layer from the inner thicker layer. Conversely, separation of particles which may have carbon constituents can result in splitting of the stream to provide a very thin inner layer 76 and a relatively thick outer 78. Such positioning of the knife edge 72 can be accomplished by trial and error depending upon the particles being processes and the knowledge with which they separate radially in swirl-flow layer.

Figure 5B:
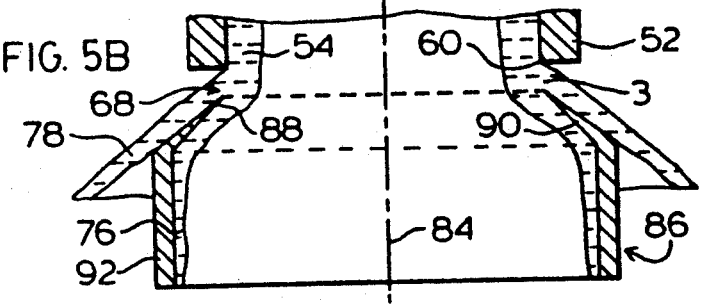
Figure 5C:
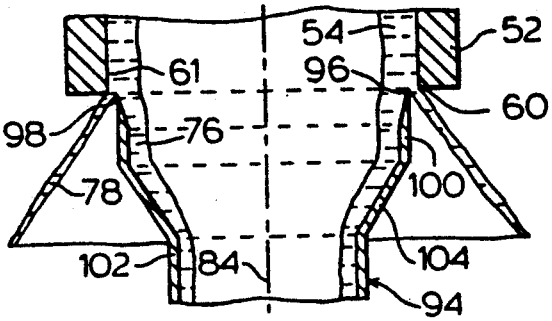

Alternative structures for the splitting device are shown in FIGS. 5*b* and 5*c*. In FIG. 5*b*, the outlet 60 remains the same as with the embodiment of FIG. 5*a* which allows the downwardly directed swirl-flow layer 54 to splay outwardly at 68. The cylindrical tube 86 is positioned co-axially with the axis 84 of the vessel. The circular tube 86 may be either stationary mounted or movable relative to the outlet 60 in the manner discussed with respect to FIG. 5*a*.

The knife edge 88 is positioned in the outwardly splayed stream to develop the inner stream layer 76 and the outer stream layer 78. However, with the embodiment of FIG. 5*b*, the knife 88 is presented at the end of a truncated cone portion 90. The angle of the cone portion is chosen to resemble the angle of the stream as it splays outwardly at the base of the outlet 60. This provides for a quasi-parallel separation of the streams 76 and 78 as they flow over the conical portion before turning the stream 76 inwardly along the circular portion 92 of the tube 86.

The embodiment of FIG. 5*c* has a funnel-shaped tube 94 supported co-axially with the axis 84 of the vessel 52. The stream 54 splays outwardly at the outlet 60 in the manner discussed with respect to FIG. 5*a*. The funnel-shaped tube 94 has a knife edge 96 positioned radially inwardly of the interior wall 61 defining the outlet 60 to allow splitting of the stream as it begins to splay outwardly in region 98 of the vessel outlet. The knife edge 96 then splits the stream into separate streams 76 and 78. The stream 76 is collected from the inside of the tube 94 and the other stream collected from the outside of the tube 94. The knife edge 96 is defined by a sharpened cylindrical portion 100 which then converges to the circular wall 102 by converging conical portion 104. Hence both streams continue their downward travel from the outlet of the vessel 52. The knife edge 96 may be moved longitudinally, inwardly and outwardly of the outlet 60 to again achieve a splitting of the stream at the desired radial location thereof to effect separation of desired particles from unwanted particles.

Although the system, as discussed with respect to FIG. 5, involves a flow of liquid with or without air sparging, it is understood that the separation device of FIG. 5 may also be applied to separating particles moving within the gaseous stream. As it appreciated in cyclonic separators for separating particles due to centrifugal forces or as will be discussed with respect to other embodiments of the invention involving magnetic field forces and electrical forces, a gradient of particles may be established in the swirl-flow layer. The separating device of FIGS. 5*a, b,* or *c* or equivalents thereof may be employed to separate the gaseous stream into two downwardly flowing streams wherein particles of one desired classification are in one stream and particles of another classification are in the other.

Aspects of the invention as they relate to separation of particles in either liquid or gaseous streams are discussed with regard to FIGS. 6 through 12. The wet separation system of FIG. 6 resembles in some respects the separation system of FIG. 1. However, the system of FIG. 6 does not have a froth flotation core with a pedestal and vortex finder. Instead, the separation apparatus 106 has an involute injection device 108 for developing a swirl-flow of the slurry travelling in the direction of arrow 110. The slurry flows through the involuted path 112 of device 108 to develop a swirl-flow generally designated 114 for the slurry. The swirl layer 116 is subjected to air sparging by injection of air in direction of arrows 118 through the porous wall 120 of the cylindrical vessel 122. The porous wall 120 of the vessel may be a solid wall with apertures provided therein, or a sintered material which provides a desired degree of porosity for air bubbles to enter inside of the vessel 122. The air injected into the vessel may be contained in a plenum as discussed with respect to FIG. 1. Outwardly of the plenum are a plurality of magnets 124 and 12 which develop the desired magnetic field in the vessel as discussed with respect to FIGS. 2 and 3. Such hydrostatic, centrifugal and magnetic forces develop a separation of particles in the downwardly directed swirl-flow stream 114. The swirl-flow stream is permitted to exit the outlet 128 of the vessel and splay outwardly at 130 in the same manner as discussed with respect to FIG. 5. The stream splitter 132, as employed at the base of the vessel, is the same as the stream splitter of FIG. 5*a*. With this particular liquid system, the stream splitter is located so as to split the streams into a stream 134 which carries primarily magnetic and hydrophillic particles and an inner stream 133 which carries primarily diamagnetic and hydrophobic particles.

Figure 6:
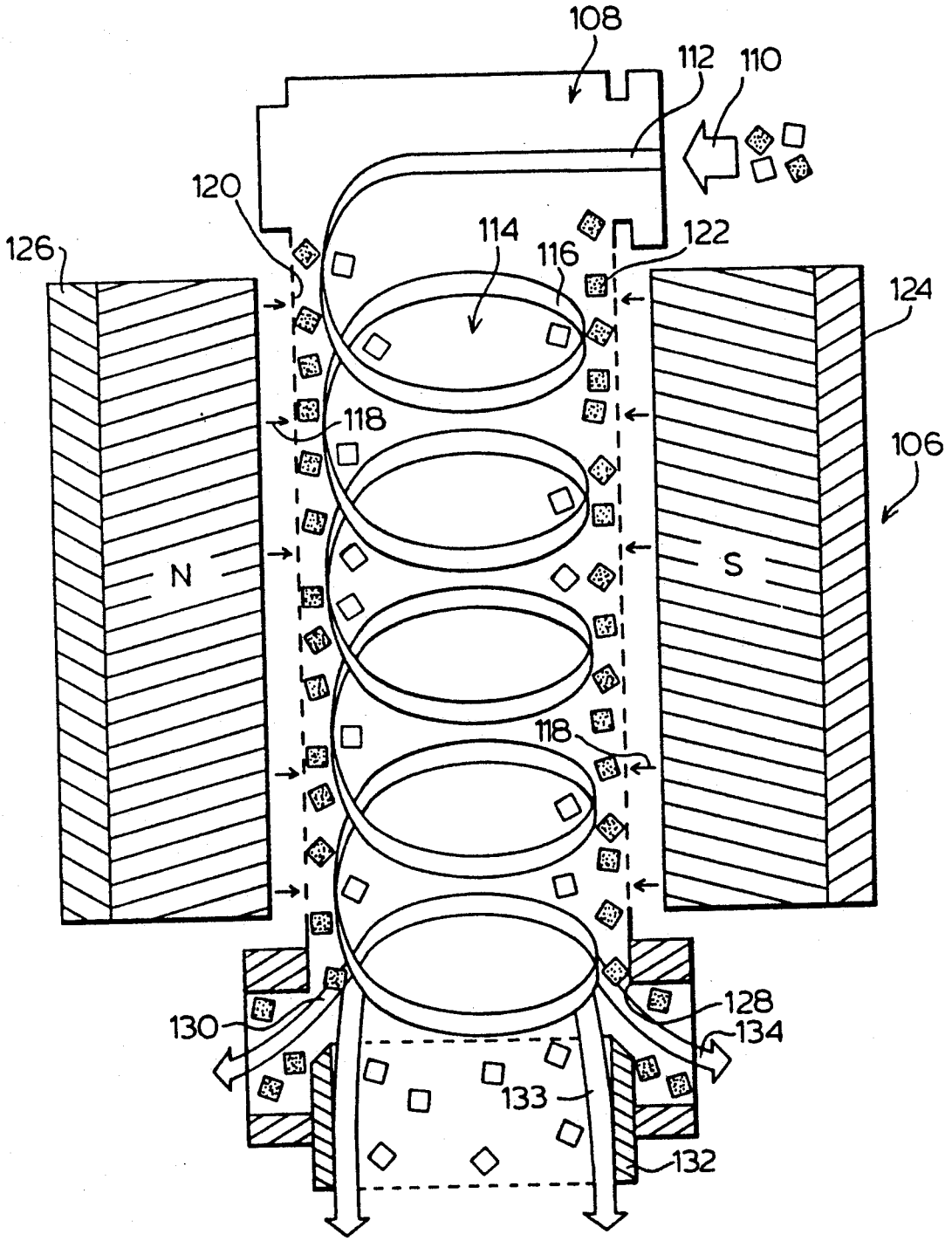
FIG. 6 is a sectioned view of the stream splitter of FIG. 5*a* used in the wet separation system.

From a processing standpoint, the apparatus of FIG. 6 functions as follows. A slurry flow of a certain thickness is developed in the circumferential direction along the inside of the vessel all, and is discharged through the lower portion of the cylinder. Air is introduced into the cylindrical vessel through the jacketed porous vessel walls, and is sheared into numerous bubbles by the high velocity swirl-flow of the slurry. A bubble generation mechanism is a two-stage process. Air migrates through the micro channels of the porous cylinder. When leaving the pore, air creates a small cavity in the slurry. The cavity grows until the surface tension is smaller than the shearing force of the flowing slurry. Once a bubble is sheared off from the surface of the cylinder, it begins to flow with the slurry at the same speed as particles in the slurry. The radial gravity force creates an upward hydrostatic pressure. It moves the bubble towards the "surface of the slurry". The bubble possesses velocity which has two components: 1) tangential component which is equal to the tangential velocity of slurry; and 2) radial velocity which is due to the buoyancy. This means that the bubble travels perpendicularly to the motion of the slurry increasing the probability of collision with particles in the slurry. The radial gravity field creates relatively high pressure in the slurry. The bubbles will move relatively fast towards the centre of the cylinder. The bubbles collide with the particles, and hydrophobic particles become attached to the bubble. Bubble-particle agglomerate is transported radially towards the radially inner surface of the slurry layer. On the other hand, the hydrophillic particles generally remain radially outwardly of the slurry layer, and thus continue to move in the swirl direction along the porous vessel wall until they are discharged at the bottom end of the vessel.

The outer wall of the apparatus comprises a quadrapole magnet. The poles are oriented towards the axis of the apparatus, and the quadrapole configuration provides radial magnetic field with no components along the axis and with a net magnetic filed at the centre of the vessel equal to zero. It is appreciated that the magnetic field can be created by either permanent magnets or by electromagnets. The operation of the present invention requires that the slurry be introduced into the cylindrical vessel through a tangential inlet in the cyclone head at the top of the vessel. The slurry forms a thin layer beneath the inside surface of the porous wall. Air is continuously sparged through the porous wall and into the thin swirl layer. Bubbles form in the slurry collide with the particles in the slurry and form bubble particles aggregate with the hydrophobic particles of the slurry. Due to the circular motion of the slurry and due to the radial geometry of the magnetic field and magnetic field gradient the slurry flow is always perpendicular to the magnetic force and to the means low of bubbles. Generally, there are two different forces acting on a hydrophillic paramagnetic or ferromagnetic particle in the slurry, as already discussed with respect to FIG. 4. The first of these forces is the radial gravity force, $F_c$, that is due to the circular motion of the slurry. The second force is a magnetic attraction force, $F_m$. These two forces act on the particle in the direction radially outward from the centre of the cylindrical vessel.

On the hydrophobic and diamagnetic particles which have formed aggregates with the air bubbles, there are generally three forces acting on them. They are the hydrostatic or buoyancy force, $F_h$, which is the force transporting the bubble particle aggregate towards the inner surface of the slurry stream, the magnetic repelling force, $F_r$, and the radial gravity force $F_c$. The hydrostatic and the magnet repelling forces act on the particles in a radially inward direction whereas the centrifugal force acts on the particles in a radial outward direction. The combined action of these three forces is a net force acting radially inward towards the centre of the cylindrical vessel.

The above described process is more efficient when the medium or slurry flows in laminar manner. The laminar flow is characterized by constant angular velocity for all flowing medium particles, and by no significant relative movement of particles in respect to each other. Turbulent flow is characterized by the distribution of particle velocities (moduli and directions), with a mean value parallel to flow. The laminar velocity of particle will have two components, $V_1$ parallel and $V_2$ perpendicular as shown in FIG. 5*a*. These two components create a spiral flow of medium in the form of the swirl layer. When the swirl layer reaches the end of the cylinder, the vessel wall no longer contains the swirl flow so that the medium splays outwardly on flowing out of the lower outlet. The swirl layer is discharged forming a conical shape. The cone angle will depend on $V_1$ to $V_2$ ratio and the thickness of the cone layer will decrease with increasing distance from the cylinder. At the outlet end of the vessel is the co-axially positioned stream splitter of FIG. 5*a*. Its diameter and the shape of the dye nest to the vessel can be adjusted as required. The cylinder can be displaced along the axis of the apparatus in both directions by rotation or by other means. This displacement will change the length of the gap between the vessel and the cylinder. The second cylinder splits the flow into two streams. The splitting ratio and the cutting point within the swirl layer are adjusted by changing the length of the gap. Particles which are closer to the cylinder wall will be discharged outside the cylinder through a diaphragm. Particles which are closer to the cylinder axis will flow coaxially.

The combined action of radial gravity force (centrifugal force) and radial magnetic force with the flotation inside the vessel imposes the distribution of the particles along the swirl layer thickness by mass, by surface properties, and by magnetic properties. The cutting point of the stream splitter is adjusted to achieve required separation of the particles.

Figure 7:
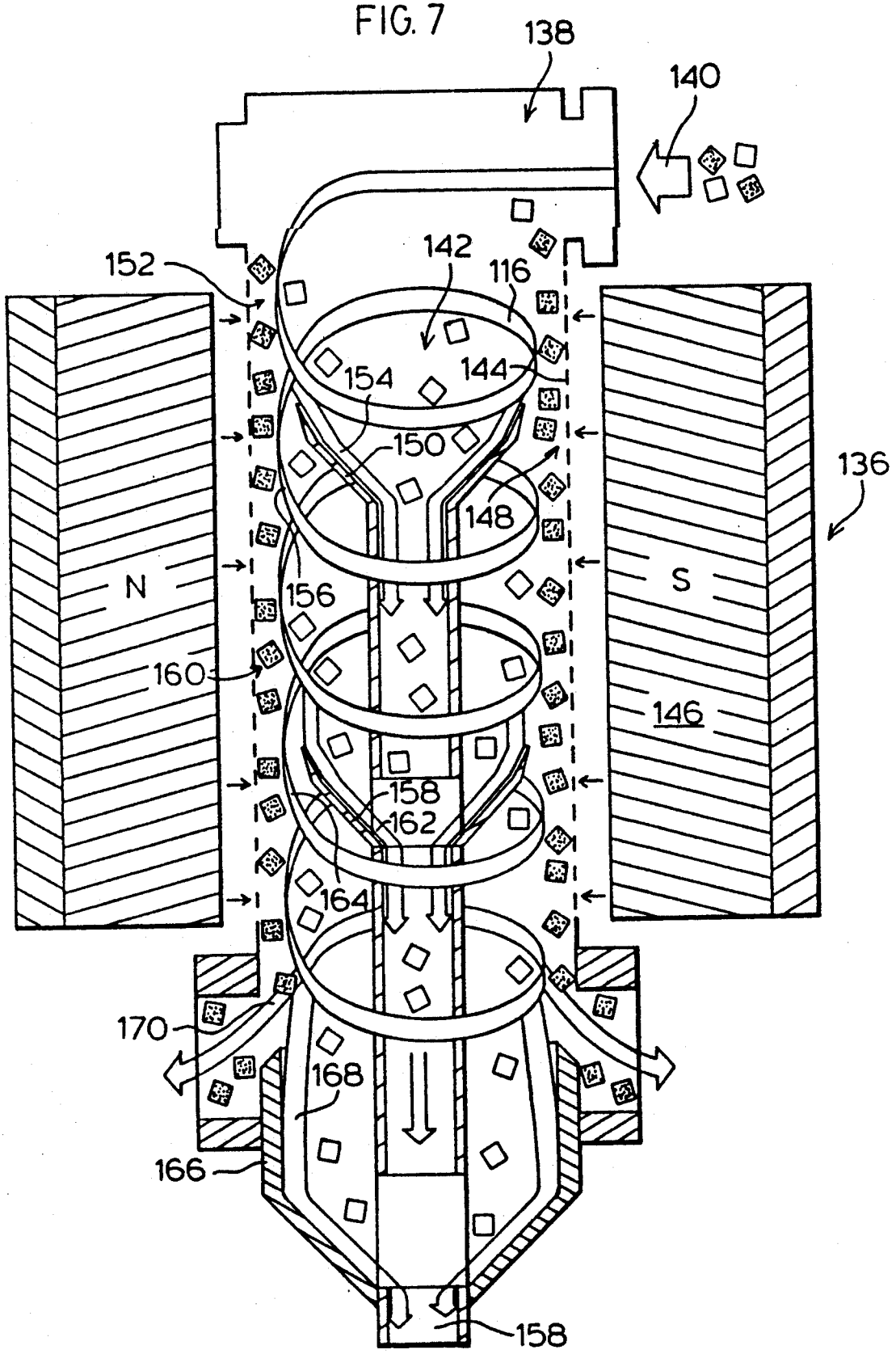
FIG. 7 shows the use of the stream splitter of FIG. 5*c* in combination with other stream splitters located internally of the wet separation system.

An alternative embodiment for the stream splitter mechanism is shown in FIG. 7. The separation apparatus 136 has the same slurry injection device 138 as in FIG. 6 for directing the slurry in the direction of arrow 140 into a swirl-flow pattern 142. Air sparging through the porous vessel wall 144 is provided along with a magnetic field gradient provided by magnets 146. The hydrostatic, centrifugal and magnetic forces acting on the particles develop a radial gradient of the particle in the swirl-flow layer 148. The stream splitter mechanism of FIG. 7 is adapted to separate the stream into two streams at several locations along the length of the separation apparatus 136. The first stream splitter 150 is located near the inlet region 152 to effect a splitting of the stream into two streams 154 and 156. The inner stream 154 is fed downwardly to the outlet 158 of the stream splitter device. Splitting of the stream at the inlet region separates the particles which, in this embodiment, are the bubble/particle aggregates which have developed inwardly of the stream relative to the paramagnetic, ferromagnetic hydrophillic particles at the outer periphery of the stream. A second stream splitter 158 is located in the mid-region 160 of the vessel to again split the streams into an inner stream 162 and an outer stream 164. The inner stream consists primarily of the bubble/particle aggregates which have formed since the second stream 156 has flowed past the first stream splitter 150.

At the outlet of the vessel is the third stream splitter 166 which divides the stream as it splays outwardly from the outlet into two streams 168 and 170. The third or tertiary stream splitter then effects the last separation of the bubble/particle aggregates from the stream 164. By way of this multi-stage stream splitter device of FIG. 7, there is the enhanced production and layering of the bubble/particle aggregates because, as the swirl stream flows downwardly through the vessel, the developed layer of bubble/particle aggregates is removed in stages to allow development of a new layer of bubble/particle aggregates.

Figure 8:
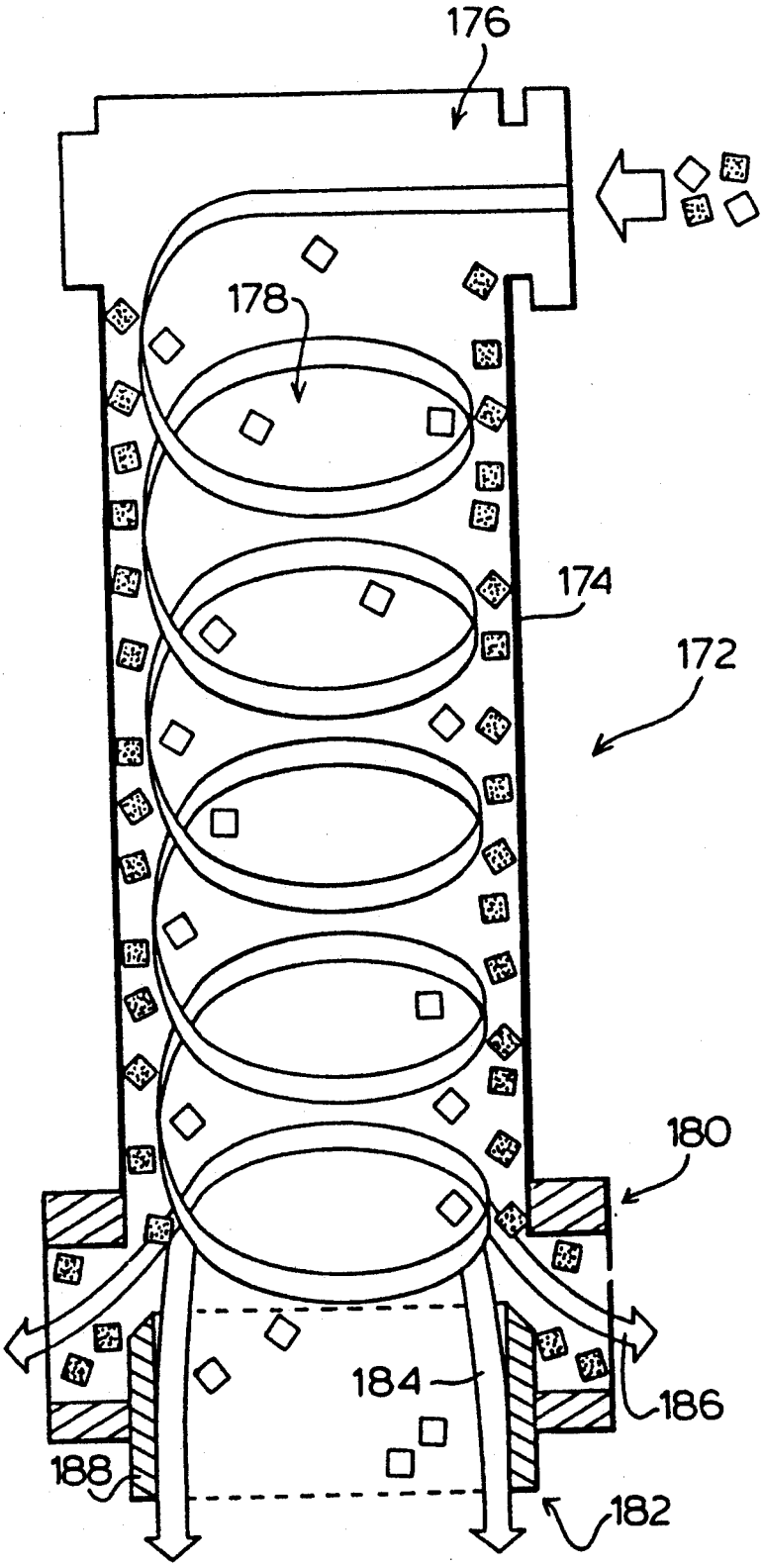
FIG. 8 is a sectioned view of the stream splitter of FIG. 5*a* used in an alternative embodiment for the wet separation system having a solid wall configuration.
Figure 9:
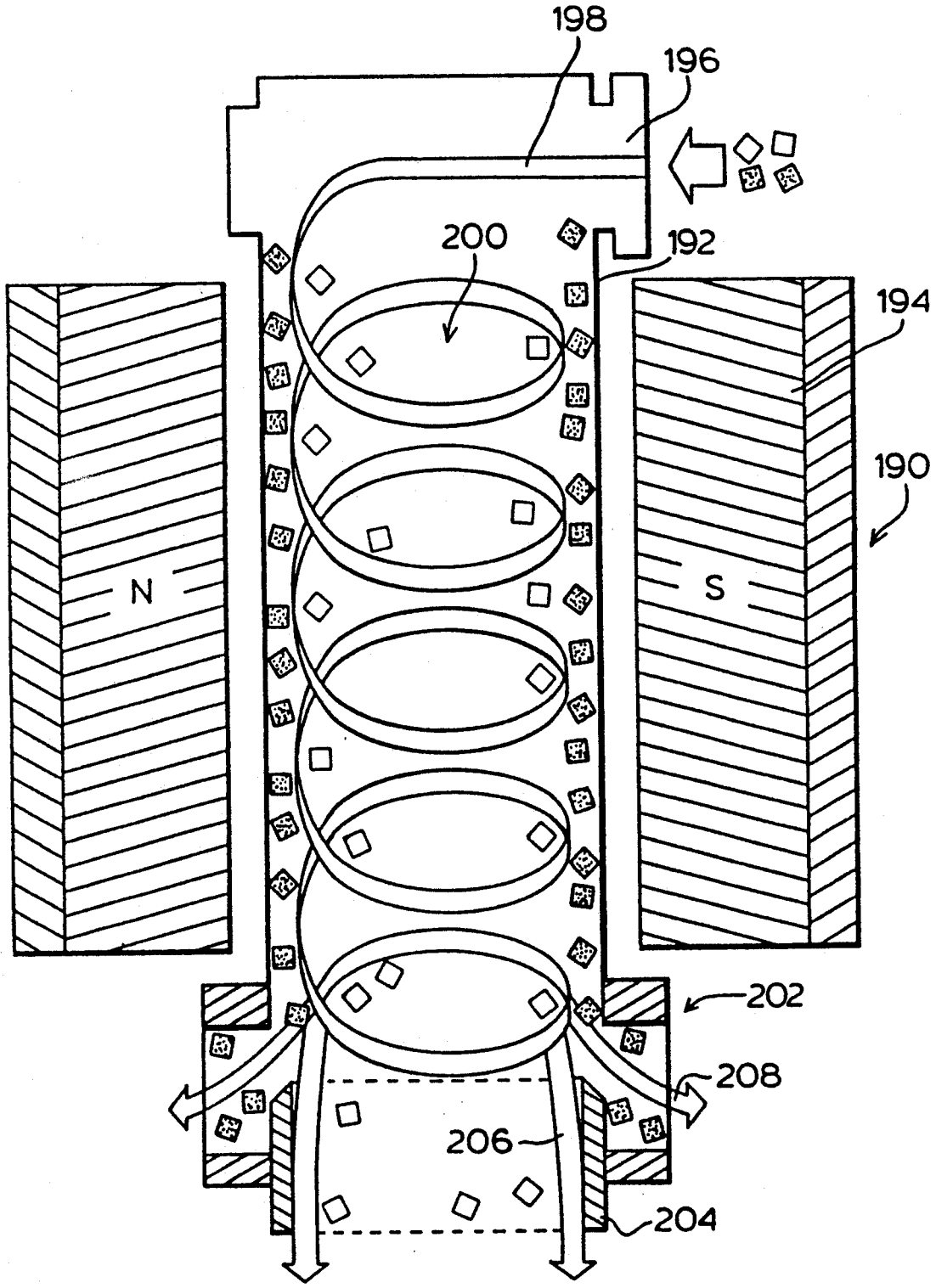
FIG. 9 is a sectioned view of the stream splitter of FIG. 5*a* used with a wet separation system having quadrapole magnets with solid wall configuration.

FIGS. 8 and 9 show alternative embodiments of the invention where the stream splitter is used to split streams in which either centrifugal forces act on the slurry to develop a radial gradient of particle separation or in FIG. 9, a centrifugal field in combination with a magnetic field operate on the stream to develop the radial separation of particles. In the embodiment of FIG. 8, the apparatus 172 has a solid cylindrical wall 174. Hence air sparging is not used in this apparatus. The inlet 176 to the vessel develops the swirl-flow pattern 178 for the slurry. By way of centrifugal forces acting on the particles, the heavier particles move to the outside of the slurry layer and the lighter particles move to the inside of the slurry layer. At the outlet end 180 of the vessel, a stream splitter 182 is provided which is of the type shown in FIG. 5*a*. The stream splitter develops two streams 184 and 186. The inner stream within the splitter tube 188 contains the lighter particles, whereas the outer stream 186 contains the heavier particles.

The apparatus of FIG. 9 has a separation system 190 with a solid cylindrical vessel wall 192 about which the magnets 194 are placed. The inlet 196 of the vessel has a flowpath 198 which develops the swirl-flow pattern of the slurry layer 200. The combination of centrifugal forces and magnetic forces develop a radial gradient separation of the particles. At the outlet end 202 of the vessel is the stream splitter 204 which splits this swirl-flow layer into two streams 206 and 208. The inner stream 206 contains the lighter particles as well as the diamagnetic particles. The outer stream 208 contains the heavier particles and magnetic particles. Hence the stream splitter mechanism of this invention may be employed with a variety of systems for separating particles in liquid streams. It is also appreciated that the multi-stage stream splitter, as discussed with respect to the air sparged system, may equally be employed in the embodiment of FIGS. 8 and 9.

Figure 10:
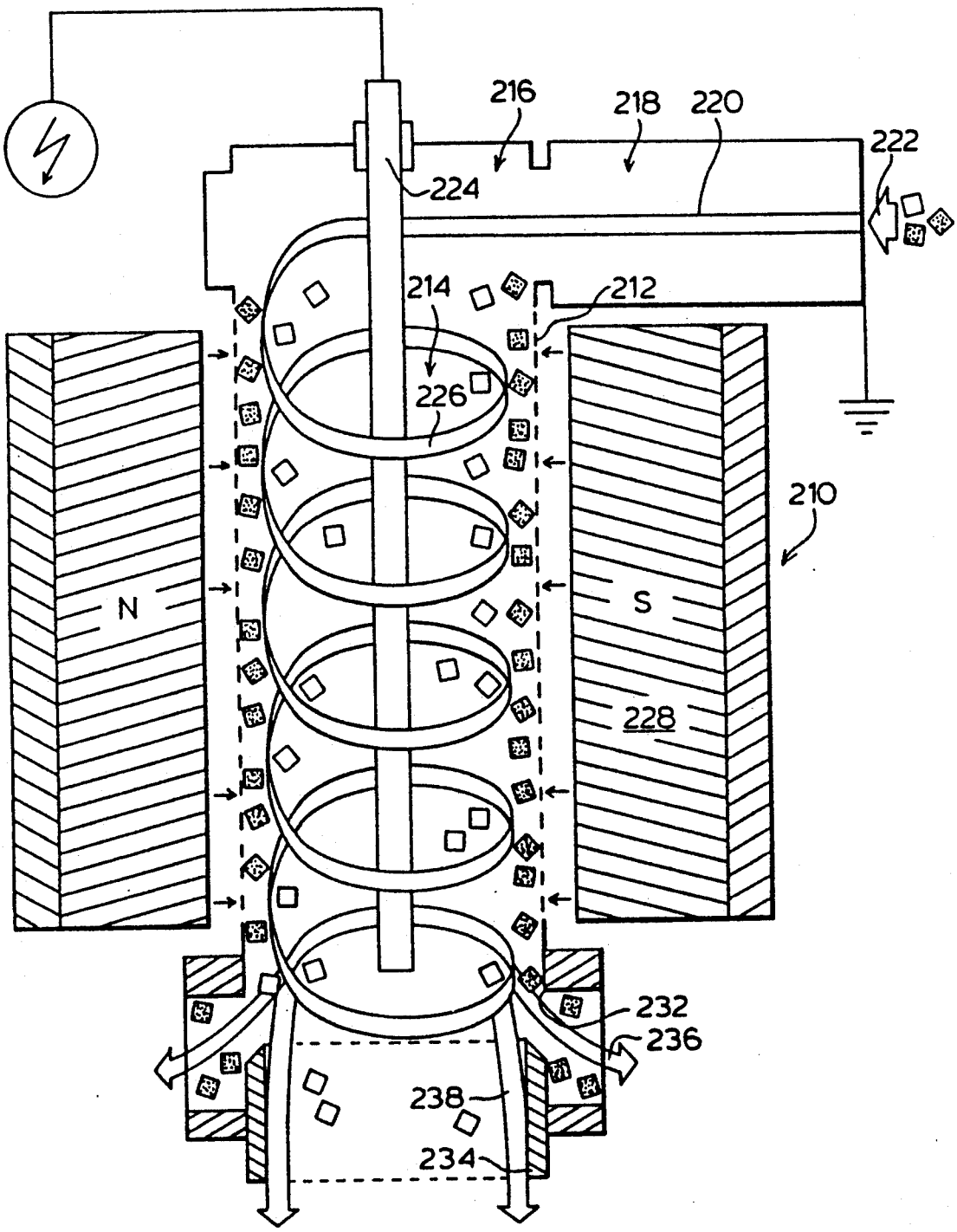
FIG. 10 shows the use of a stream splitter of FIG. 5*a* with a dry separation system having a magnetic field and an electrically charged field for enhancing separation of particles.

Various aspects of this invention may also be used to effect a desired separation of particles in a gaseous stream. A representative system is shown in FIG. 10. The dry separation apparatus 210 has a cylindrical vessel 212 into which the gaseous stream is introduced in a swirl-flow pattern 214 by the induction head 216. At the entrance to the swirl-flow induction head 216 is a particle charging device 218 which consists, of a plurality of copper tubes 220 which are negatively charged. The gaseous stream 222, which carries various particles, passes through the copper tubes whereby positive and negative charges are imparted to the particles.

In this embodiment, separation of the particles in the swirl-flow stream is accomplished by a combination of centrifugal, magnetic and electrostatic field forces acting on the particles. The electrostatic field forces are developed by positioning a high voltage electrode 224 centrally of the vessel 212. Depending upon the polarity of the electrode, like charged particles are repelled by the electrode whereas opposite charged are attracted towards the electrode. This develops radial movement of the charged particles to develop a radial gradation of the particles in the swirl-flow stream 226.

Quadrapole magnet 228 is positioned about the cylindrical vessel 212 to develop a magnetic field which attracts the paramagnetic and ferromagnetic particles towards the vessel wall 212. The diamagnetic particles are repelled radially towards the centre of the vessel 212. Hence the magnetic field causes separation of the para- and ferromagnetic particles from the diamagnetic particles.

The vessel wall 212, as shown in FIG. 11, has tangentially directed perforations or openings 230 provided therein. This continues to direct the swirl flow of the gaseous stream 226 towards the outlet 232 of the vessel 212. The tangential openings 230 are arranged so as to induce minimal turbulence in the swirl-flow stream.

The swirl-flow stream 226 exists the vessel at the outlet 232. A stream splitter 234 of the type of FIG. 5*a* is positioned co-axially at the outlet 232 to split the stream 226 into an outer stream 236 and an inner stream 238. The outer stream 236 primarily comprises the heavier magnetic and like-charged particles, whereas the inner stream contains the lighter diamagnetic oppositely charged particles. It is appreciated that separation may also be achieved in the system of FIG. 10 by simply applying centrifugal forces in combination with either an electric field or a magnetic field. This may be accomplished by removing the power from either the magnets or the central electrode which produces the respective magnetic field or electric field.

Figure 12:
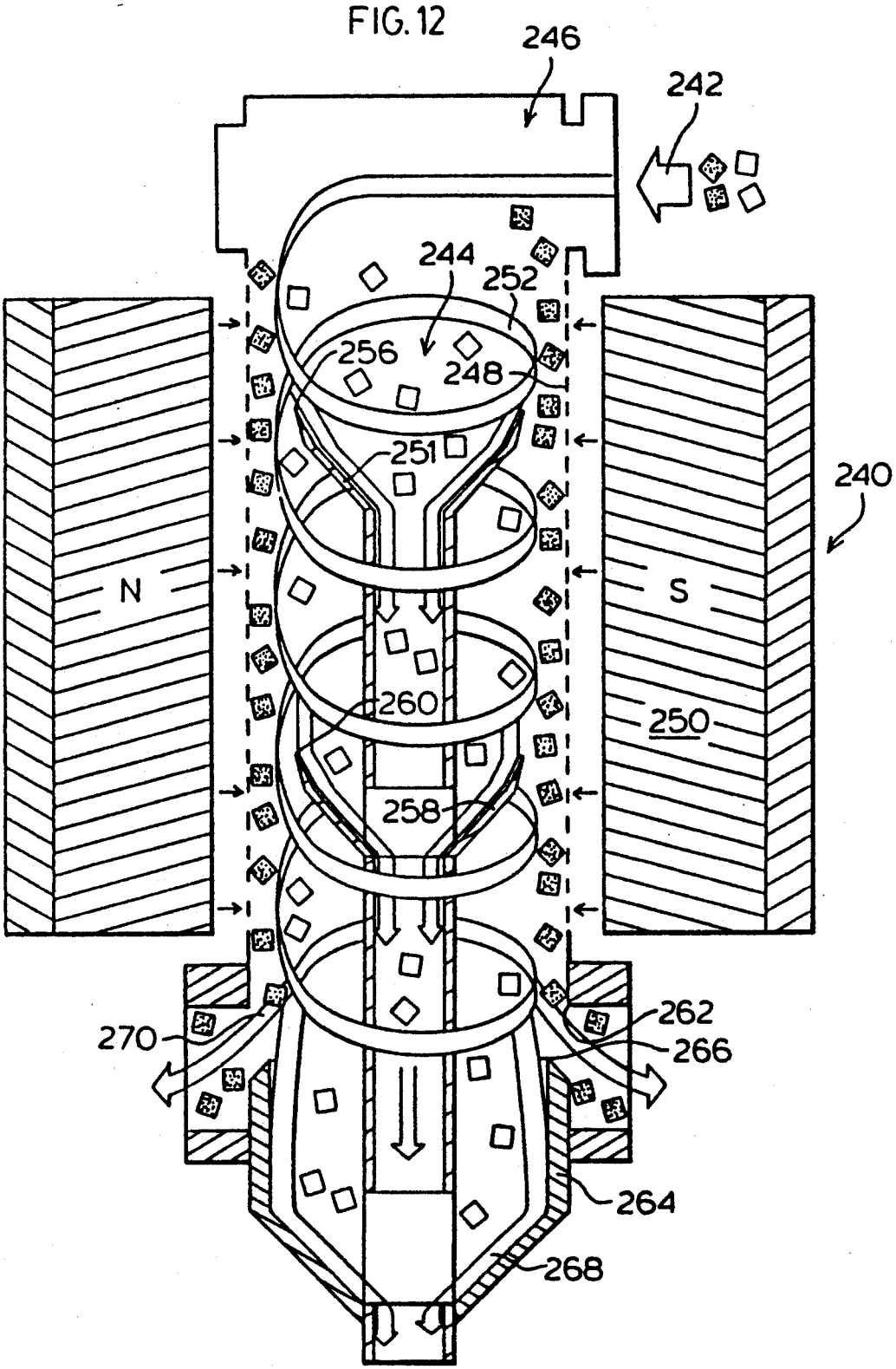
FIG. 12 is a section showing the use of the stream splitter of FIG. 5*c* in conjunction with other stream splitters located internally of the dry separation system.

The multi-stage splitter arrangement, as discussed with the wet system in FIG. 7, may also be applied to the dry separation system as shown in FIG. 12.

The separator system 240 has a similar set-up to that of FIG. 10. The gaseous stream 242 is directed into a swirl-flow pattern 244 by the stream introduction device 246. The cylindrical vessel 248 may optionally have air introduction in the manner of FIG. 11 into the swirl-flowing stream. The embodiment of FIG. 12 does not include the electrode for generating the electric field within the vessel. However, a magnetic field is employed as provided by the quadrapole magnet 250. By virtue of centrifugal and magnetic fields, separation of particles is achieved in the swirl-flowing stream 252. A multi-stage stream separator is provided internally of the vessel 248 and consists of three funnel-shaped separators as shown in section in FIG. 12. The first stream separator 254 has the knife edge 256 positioned to separate the inner layer of lighter particles from an outer layer of heavier particles in the stream 52. Similarly, the second stream splitter 258 has knife edge 260 to effect a similar separation and at the outlet 262 of the vessel, a third stream splitter 264 is provided where knife edge 266 splits the outcoming stream into two final streams 268 and 270. By way of this multi-stage stream splitter device, the lighter particles as they migrate radially inwardly are removed from the radial innermost portion of the stream to thereby allow other lighter particles to also migrate in that direction; hence providing a more effective, efficient removal of the lighter particles in separating them from the heavier para- and ferromagnetic particles. Such multi-stage separator can reduce the overall length of the separator system.

It is understood that the stream splitter at the outlet of the cylindrical vessel may be moved longitudinally relative to the outlet to vary the positioning of the knife edge in the outlet outwardly splayed stream, thereby changing the gradient of particles which are split in the inner and outer streams.

Although preferred embodiments of the invention are described herein in detail, it will be understood by those skilled in the art that variations may be made thereto without departing from the spirit of the invention or the scope of the appended claims.

We claim:

1. An apparatus for separating particles based on their different characteristics in a fluid stream, said apparatus comprising:

i) an elongated, essentially cylindrically shaped vessel having a defined diameter, a first end and a second end, and a circular shaped outlet located at said second end and having a defined diameter essentially equal to said diameter of said cylindrically shaped vessel ii) inlet means for developing in said vessel a swirl-flow pattern of a fluid stream carrying such particles, said particles moving in an essentially nonturbulent manner;

iii) means for developing a radial distribution of particles in such fluid stream by virtue of one or more physical, electrical or magnetic properties of such particles;

iv) said outlet being unobstructed at its periphery to permit said fluid stream travelling in a swirl-flow manner to splay outwardly in a conical manner beyond said periphery of said outlet;

v) means for imparting positive and negative charges to said particles associated with said inlet means for imparting positive and negative charges to said particles prior to development of said swirl flow pattern;

vi) said means for developing a radial distribution of particles comprising an electrically charged rod located centrally of an extending along said vessel to attract oppositely charged particles and repel-like charged particles in said fluid stream;

vii) a circular tube spaced from said outlet periphery, said circular tube having an inlet diameter less than or equal to said diameter of said circular shaped outlet;

viii) means for supporting said tube with a longitudinal axis for said tube being coincident with a central axis of said circular outlet, ix) said support means axially spacing an inlet periphery of said tube apart from said outlet periphery, said tube inlet diameter being such to intersect such outwardly splayed fluid stream to split said stream into two sub-streams whereby a majority of particles of a desired characteristic are in one of said sub-streams.

2. An apparatus of claim 1 wherein said support means comprises means for moving said tube inlet periphery along said longitudinal axis to adjust thereby the extent to which said tube inlet periphery intersects such splayed stream, said support means having means for retaining said tube inlet periphery in a desired position.

3. An apparatus of claim 1 adapted to separate particles in such fluid stream wherein said fluid is a liquid and said inlet means is located at said first end of the vessel.

4. An apparatus for separating particles based on their different characteristics in a fluid stream, said apparatus comprising:

i) an elongated, essentially cylindrical shaped vessel having an interior wall which defines a diameter, a first end and a second end, and a circular shaped outlet located at said second end and said outlet having a defined diameter essentially equal to said diameter of said cylindrical shaped vessel;

ii) inlet means for introducing said fluid stream into said vessel and for developing in said vessel a swirl-flow pattern of a fluid stream carrying said particles along said interior wall;

iii) magnetic means associated with said vessel for developing a radial magnetic field and a magnetic field gradient within said vessel, said magnetic means developing a magnetic field and a magnetic field gradient at the vessel interior wall and a net zero magnetic field centrally of said vessel.

iv) at least a portion of said interior wall being porous, means for introducing air through said porous portion to form air bubbles in said fluid stream to enhance thereby separation of hydrophobic particles attracted to air bubbles which form particle/-bubble aggregates from hydrophilic particles not attracted to air bubbles, said air introduction means and said magnetic means provide in combination a radial distribution of particles in said fluid stream due to hydrostatic forces acting on said hydrophobic aggregates to move such aggregates radially inwardly of said fluid stream, and wherein centrifugal forces acting on said particles and said aggregates act to move said particles radially outwardly and wherein said magnetic field forces acting on said particles and said aggregates act to move ferromagnetic and paramagnetic particles radially outwardly and diamagnetic particles radially inwardly;

v) said outlet being unobstructed at its periphery to permit said fluid stream travelling in a swirl-flow manner to splay outwardly in a conical manner beyond said periphery of said outlet;

vi) a circular tube spaced from said outlet periphery, said circular tube having an inlet diameter less than or equal to said diameter of said circular shaped outlet;

vii) means for supporting said tube with a longitudinal axis for said tube being coincident with a central axis of said circular outlet, viii) said support means axially spacing an inlet periphery of said tube apart from said outlet periphery, said tube inlet diameter being such to intersect such outwardly splayed fluid stream to split such stream into two sub-streams whereby a majority of particles of a desired characteristics are in one of said sub-streams.

5. An apparatus for separating particles in a gaseous fluid stream which is moving in a swirl-flow manner, said apparatus comprising:

i) an elongated vessel having a circular shaped interior wall, first and second ends, and a circular shaped outlet adjacent to said second end;

ii) means for introducing said fluid stream into said vessel to develop said swirl-flow along said interior wall, said fluid steam introduction means located adjacent to said first end of said vessel;

iii) magnetic means for developing a radial magnetic field and a magnetic field gradient within said vessel;

iv) said magnetic means developing a strong magnetic field and magnetic field gradient at said vessel interior wall and a net zero magnetic field centrally of said vessel;

v) said magnetic providing a radial distribution of particles in said fluid stream due to centrifugal forces acting on said particles to move such radially outwardly and magnetic field forces acting on said particles to move ferromagnetic and paramagnetic particles radially outwardly and diamagnetic particles radially inwardly;

vi) means for imparting an electrical charge to particles in said fluid stream being provided in said fluid introducing means for said vessel;

vii) an electrically charged rod located centrally of and extending along said vessel to attract oppositely charged particles and repel like charged particles in said fluid stream;

viii) such electrically charged rod further enhancing radial separation of such particles due to the combination of centrifugal, magnetic and electrical forces acting on such particles;

ix) said outlet being unobstructed at its periphery to periphery to permit said fluid stream traveling in a swirl-flow manner to splay outward in a conical manner beyond said periphery of said outlet;

x) means for splitting said fluid stream into at least two separate streams, wherein one of said separate streams contains a high concentration of ferromagnetic and paramagnetic particles.

6. An apparatus for separating particles in a gaseous fluid stream which is moving in a swirl-flow manner, said apparatus comprising:

i) an elongated vessel having a circular shaped interior wall, first and second ends, and a circular shaped outlet adjacent to said second end;

ii) means for introducing said fluid stream into said vessel to develop said swirl-flow along said interior wall, said fluid stream introduction means located adjacent to said first end of said vessel;

iii) magnetic means for developing a radial magnetic field and a magnetic field gradient within said vessel;

iv) said magnetic means developing a strong magnetic field and magnetic field gradient at said vessel interior wall and a net zero magnetic field centrally of said vessel;

v) said magnetic means providing a radial distribution of particles in said fluid stream due to centrifugal forces acting on said particles to move such radially outwardly and magnetic field forces acting on said particles to move ferromagnetic and paramagnetic particles radially outwardly and diamagnetic particles radially inwardly;

vi) said outlet being unobstructed at its periphery to permit said fluid stream traveling in a swirl-flow manner to splay outwardly in a conical manner beyond said periphery of said outlet;

vii) means for splitting said fluid stream into at least two separate streams, wherein one of said separate streams contains a high concentration of ferromagnetic and paramagnetic particles;

viii) wherein said circular interior wall includes a plurality of tangentially oriented apertures and means for injecting air through said apertures into said vessel to direct said swirl-flow along said interior wall toward said vessel outlet with minimum turbulence induction.

7. An apparatus for separating particles based on their different characteristics in a fluid stream, said apparatus comprising:

i) an elongated cylindrical shaped vessel having a circular shaped outlet and a circular shaped interior wall, at least a portion of said wall being porous;

ii) means for developing in said vessel a swirl-flow pattern of a fluid stream carrying such particles;

iii) means for developing a radial distribution of particles in such fluid stream by virtue of one or more physical, electrical or magnetic properties of such particles;

iv) said radial distribution development means comprising means for introducing air through such porous portion to form air bubbles in said fluid stream to enhance thereby separation of hydrophobic particles attracted to air bubbles which form particle/bubble aggregates from hydrophilic particles not attracted to air bubbles, said air introducing means providing a radial distribution of particles in said fluid stream due to hydrostatic forces acting on said hydrophobic aggregates to move such radially inwardly of said fluid stream;

v) said outlet being unobstructed at its periphery to permit such fluid stream traveling in a swirl-flow manner to splay outwardly in a conical manner beyond such periphery of said outlet;

vi) a circular tube spaced from said outlet periphery;

vii) means for supporting said tube with a longitudinal axis for said tube being coincident with a central axis of said circular outlet;

viii) said support means axially spacing an inlet periphery of said tube apart from said outlet periphery, said tube inlet diameter being such to intersect such outwardly splayed fluid stream to split said stream into two sub-streams whereby a majority of hydrophobic particles are in one of said sub-streams.

* * * * *